United States Patent [19]

Kodate et al.

[11] Patent Number: 4,987,913

[45] Date of Patent: Jan. 29, 1991

[54] APPARATUS AND METHOD FOR CONTROLLING OPERATION OF STORM SEWAGE PUMP

[75] Inventors: Hidemi Kodate, Tokyo; Takao Kato, Yokohama; Shigeo Aoki, Inagi, all of Japan

[73] Assignee: Kabushiki Kaisha Toshiba, Kawasaki, Japan

[21] Appl. No.: 370,807

[22] Filed: Jun. 23, 1989

[30] Foreign Application Priority Data

Jun. 25, 1988 [JP] Japan ..... 63-157637

[51] Int. Cl.[5] ..... F16K 17/36

[52] U.S. Cl. ..... 137/1; 137/78.1; 137/567; 417/7; 417/14; 417/36

[58] Field of Search ..... 137/565, 78.1, 78.2, 137/78.3, 566, 567, 1; 417/7, 14, 36

[56] References Cited

U.S. PATENT DOCUMENTS 4,396,149 8/1983 Hirsch ..... 137/78.3
4,545,396 10/1985 Miller et al. ..... 137/78.3
4,705,456 11/1987 Gardeen ..... 417/7

FOREIGN PATENT DOCUMENTS 0051984 3/1982 Japan ..... 417/42

OTHER PUBLICATIONS

Journal of the Hydraulics Division, Nov. 1989, pp. 1809–1834.

Proc. Nowcasting-H Symposium, Norrkoping, Sweden, 3–7 Sep. 1984, (ESA SP-208) pp. 241–246.

Abretitsbericht Der Atv-Arbeitsgruppe 1.2.4 Abflubsteuerung in Kanalnetzen pp. 429–439, Jun. 1989.

*Primary Examiner*—A. Michael Chambers

*Attorney, Agent, or Firm*—Oblon, Spivak, McClelland, Maier & Neustadt

[57] ABSTRACT

Storm water pumps drain storm water in a pump well. In order to control the storm water pumps, a radar rain gage and ground raingages are set. Measurement data from the radar rain gage and the ground rain gages are supplied to a data processing unit. The data processing unit calibrates rainfall distribution data representing a two-dimensional rainfall distribtuion state obtained by the radar rain gate by the measurement data from the ground rain gages, and forecasts a rainfall in a predetermined time from the present from several sets of the calibrated rainfall distribution data. The data processing unit performs runoff analysis corresponding to characteristics of a drainage basin on the basis of the forecast rainfall to calculate a rainfall flow, thereby forecasting a flow of storm water flowing in the pump well. The data prcessing unit determines the number of pumps to be operated in consideration of the flow of storm water flowing in the pump well, a water level of a water level gauge, and the number of currently operating pumps, thereby controlling an operation of the storm water pumps.

16 Claims, 16 Drawing Sheets

(INPUT NODE)

| (NODE OUTPUT) | J1 | J2 | J3 | P1 | P2 |
|---|---|---|---|---|---|
| J1 | | | 1 | 1 | |
| J2 | | | 1 | | |
| J3 | | | | | 1 |
| R1 | 1 | | | | |
| R2 | | 1 | | | |
| R3 | | | 1 | | |

APPARATUS AND METHOD FOR CONTROLLING OPERATION OF STORM SEWAGE PUMP

BACKGROUND OF THE INVENTION

1. Field of the Invention

The present invention relates to an apparatus and method for controlling an operation of a storm sewage pump utilized in a sewage treatment plant or the like and, more particularly, to a storm sewage pump operation control apparatus and method for controlling the number of storm sewage pumps to be operated in consideration of temporal and spatial variations of a rainfall.

2. Description of the Related Art

A sewage treatment plant is important for sewage works. The sewage treatment plant is also essential to prevent disasters caused by a rainfall, assure sanitation of cities, and maintain good environments. From this point of view, control of the number of storm sewage pumps to be operated as sewage treatment equipment is very important. A difference between an obtained advantage and disadvantage is significantly affected by suitability of control of a storm sewage pump operation.

Rainfall handled in a sewage treatment plant changes in accordance with rainfall characteristics which areally change over time, a configuration of the ground, an arrangement of conduits, a structure of conduits, and the like. For this reason, a change over time of a rainfall in a certain area is not identical to a past one and does not have reproducibility. Such a rainfall property is called temporal and spatial variations of rainfall.

The following conventional techniques are used to forecast such a complicatedly changing rainfall and determine the number of storm sewage pumps to be operated.

1. Ground rain gages are set at a plurality of positions in an urban area. A future rainfall is forecasted by experience of a person on the basis of a rainfall measured by the ground rain gages. The number of pumps to be operated is determined on the basis of the forecasted rainfall.

2. A rainfall in each area is observed by using a radar rain gage. A future rainfall is forecasted by experience of a person on the basis of the observed rainfall. The number of pumps to be operated is determined on the basis of the forecasted rainfall.

3. A water level gauge is set in a well (pump well) from which storm water pumps pump up water. The number of storm water pumps to be operated is determined on the basis of an increase/decrease in water level measured by the water level gauge. This 3rd technique is disclosed in, e.g., Japanese Patent Disclosure (Kokai) No. 57-186080.

The 1st and 2nd techniques largely depend on experience of a person. For this reason, it is difficult to adequately determine the number of storm water pumps to be operated.

An increasing/decreasing rate of the water level of a pump well significantly differs in accordance with a structure of a conduit connected to the pump well, the type of another conduit connected to the distal end of the conduit connected to the pump well, and the like. In addition, in an urban area, along with overcrowding of houses caused by the concentration of population or the spread of paved streets, most of rain water does not penetrate into the ground but flows into sewer pipes. For this reason, since a large amount of storm water must be simultaneously drained to rivers, a storm water pump having a very large capacity has been increasingly Therefore, according to the 3rd technique, even when the number of pumps to be operated is increased on the basis of determination that the water level of a pump well rises, the water level may rapidly fall or vice versa thereafter. Therefore, in the 3rd technique, the number of pumps to be operated must be changed over time in accordance with the water level change in the pump well. This consumes a large amount of power, shortens a service life of a storm water pump, and sometimes adversely affects adequate drainage of storm water from sewer pipes to rivers.

SUMMARY OF THE INVENTION

It is an object of the present invention to provide a storm water pump operation control apparatus and method capable of analyzing a rainfall from a total point of view to adequately forecast the rainfall, thereby minimizing a change in number of storm water pumps to be operated to adequately perform drainage.

In order to achieve the above object of the present invention, a storm water pump operation control apparatus according to the present invention comprises, in a storm water pump operation control apparatus for controlling an operation of a plurality of storm water pumps for draining storm water flowing in an urban area to rivers:

- a radar raingage for observing a two-dimensional rainfall distribution for each predetermined observation period;
- ground raingages, located at a plurality of points on a ground, for measuring an actual rainfall on the ground;
- a water level gauge set in a pump well;
- a rainfall forecasting means for calibrating the two-dimensional rainfall distribution obtained by the radar raingage on the basis of the rainfalls measured by the ground raingages, and forecasting a rainfall in a predetermined time from the present on the basis of several sets of past calibrated rainfall distributions;
- runoff analyzing means for performing runoff analysis corresponding to drainage basin characteristics on the basis of the forecasted rainfall obtained by the rainfall forecasting means and calculating a rainfall flow, thereby obtaining an inlet, flow in the pump well; and
- a pump number determining means for determining the number of pumps to be operated on the basis of the pump well inlet flow obtained by the runoff analyzing means and the water level of the water level gauge and in consideration of the number of currently operated pumps.

According to the present invention comprising the above means, the two-dimensional rainfall distribution data supplied from the radar rain gage for each predetermined observation period is calibrated on the basis of the actual rainfalls measured by the ground rain gages located at a plurality of points on the ground, thereby obtaining a correct rainfall distribution of a drainage basin of interest. In addition, since a rainfall in a predetermined time from the present is forecasted on the basis of several sets of past calibrated rainfall distributions, a rainfall can be comparatively correctly forecasted. Furthermore, an inlet flow of the pump well is calculated in consideration of characteristics of, e.g., a sewer pipeline network in the drainage basin of interest. For this reason, a future amount of storm water flowing in the pump well can be comparatively correctly forecasted. The number of storm water pumps to be operated is determined on the basis of the pump well inlet flow and the water level of the water level gauge. Therefore, the number of storm water pumps can be precisely controlled.

DETAILED DESCRIPTION OF THE PREFERRED EMBODIMENTS

An embodiment of the present invention will be described in detail below with reference to the accompanying drawings.

Figure 1:
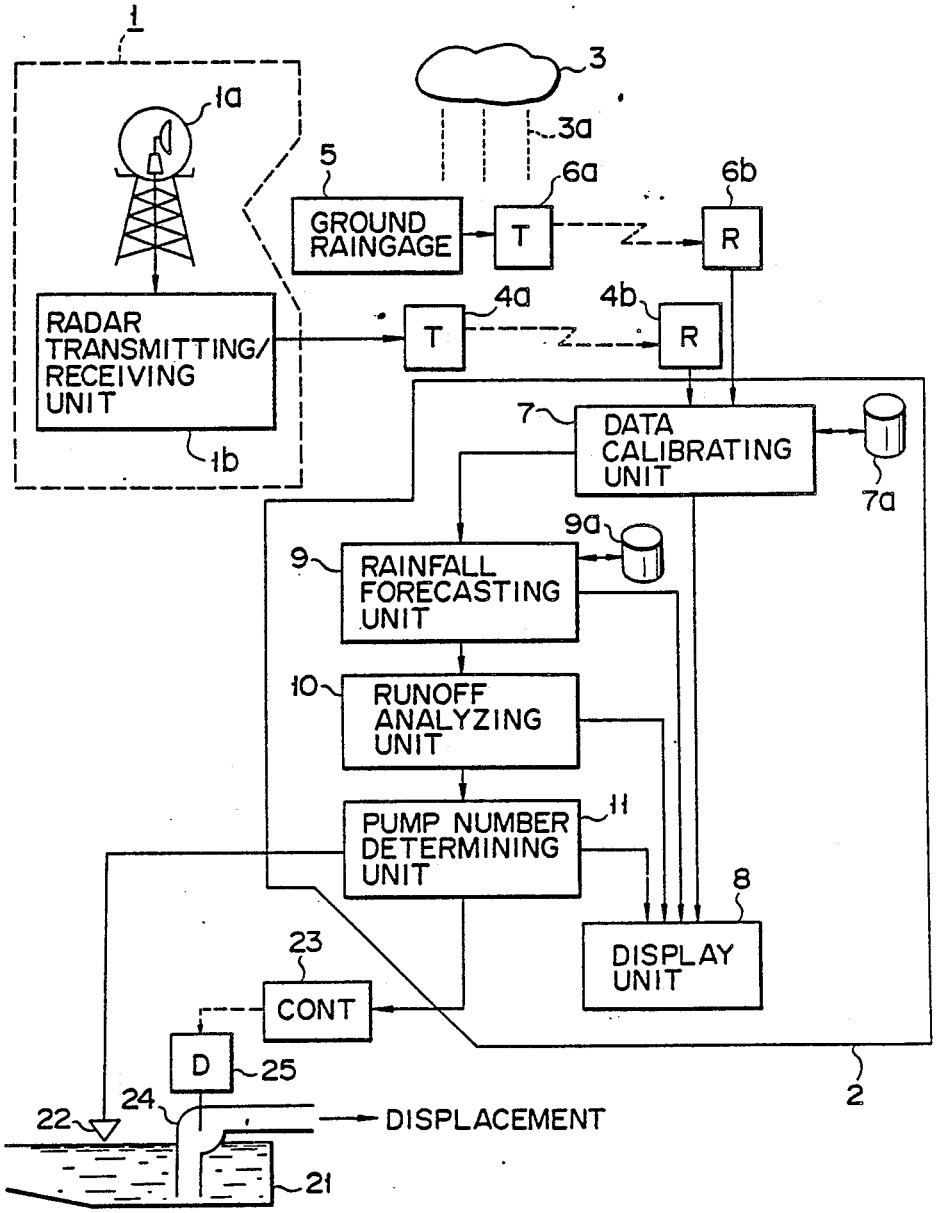
FIG. 1 is a block diagram showing an overall arrangement of a storm water pump operation control apparatus according to an embodiment of the present invention.

FIG. 1 shows an overall arrangement of a storm water pump operation control apparatus according to an embodiment of the present invention. This apparatus comprises a radar rain gage 1 including a radar antenna 1*a* and a radar transmitting/receiving unit 1*b*. At least the antenna 1*a* of the rain gage 1 is located in a comparatively open place near an urban area. The antenna 1*a* operates under the control of the unit 1*b*. The unit 1*b* generates a signal to be transmitted and transmits the signal as a radio wave from the antenna 1*a*. The unit 1*b* receives the radio wave, as radar reception power data, returned by bacKscattering by raindrops 3*a* in or falling from a rain cloud 3. The radar reception power data corresponds to data representing a rainfall distribution. The radar transmitting/receiving unit 1*b* transmits the radar reception power data to a data processing unit 2 via data transmitting units 4*a* and 4*b*. The units 4*a* and 4*b* are used because the radar rain gage 1 and the data processing unit 2 are located in different places.

A plurality of ground rain gages 5 for measuring an actual rainfall on the ground are located on the ground. The rain gages 5 are located at a plurality of points inside and outside the urban area. A tipping bucket, for example, is used as the rain gage 5. The tipping bucket tips whenever it receives a predetermined rainfall from a cylindrical water receiving port. A rainfall at a certain point is obtained by counting the number of tipping times of the corresponding tipping bucket. The rain gages 5 transmit obtained rainfall data to the data processing unit 2 via transmitting units 6*a* and 6*b*.

The data processing unit 2 comprises, e.g., a data calibrating unit 7, a rainfall forecasting unit 9, a runoff analyzing unit 10, and a pump number determining unit 11. The units 7 to 11 can be individually constituted by, e.g., a computer. Alternatively, the entire data processing unit 2 can be constituted by a single computer so that functions of the units 7 to 11 are processed by software.

The data calibrating unit 7 calibrates the radar reception power data (rainfall distribution data) from the radar rain gate 1 on the basis of the rainfall data from the ground rain gages 5. The rainfall data acquired by the radar rain gage 1 is indirect data obtained by raindrops from the rain cloud 3 and is not sufficiently reliable. Therefore, the unit 7 calibrates the rainfall data acquired by the radar rain gage 1 by using the (direct) rainfall data actually measured by the ground rain gages 5. As a result, data (rainfall distribution data) representing a two-dimensional rainfall distribution with high precision is obtained. In order to allow, e.g., an operator to understand a current rainfall distribution state, the unit 7 displays the calibrated rainfall distribution on a display unit 8. The calibrated rainfall distribution data can be printed by a printer or recorded in a recording unit. The unit 7 stores the obtained rainfall distribution data in a memory unit 7*a*, e.g., a data base.

The rainfall forecasting unit 9 forecasts a rainfall in a predetermined time from the present by using a plurality of sets of calibrated rainfall distribution data obtained by observation. In this embodiment, rainfall forecast includes dynamic forecast from a current time to a predetermined future time and static forecast for a time period after the predetermined future time (see FIG. 3). The unit 9 connects a curve (forecasted rainfall curve) representing a forecasted rainfall change to a curve (actual rainfall curve) representing an actual rainfall change obtained by observation, thereby obtaining a connected rainfall curve. The forecasted, actual, and connected rainfall curves will be described in detail later. As "calibrated rainfall distribution data obtained by past observation", calibrated rainfall distribution data concerning a current rainfall event obtained several observation periods earlier than a current time is used. The unit 9 stores the obtained connected rainfall curve in a memory unit 9*a*.

The runoff analyzing unit 10 divides a drainage basin in accordance with the number of pumps at pump stations in the urban area. The unit 10 obtains a curve representing a change in water flow flowing into a pump well (pump well inlet flow curve) at each flow. In order to obtain the pump well inlet flow curve, the unit 10 performs calculations in consideration of the connected rainfall curve, a flow of a rainfall flowing through the most downstream point of each divided drainage basin and confluence and branching of a sewer pipeline network. The unit 10 supplies the connected rainfall curve to the pump number determining unit 11.

A storm water pump 24 pumps up storm water in a pump well 21 to a river. A water level gauge 22 is set in the pump well 21 and observes a water level in the pump well 21. The pump 24 is operated/stopped by a pump driver 25. The pump number determining unit 11 holds predetermined storm water pump operation rules. The unit 11 calculates a water amount (pump delivery amount) to be discharged from the pump well 21 to the river by the pump on the basis of the pump well inlet flow curve, the measurement data of the water level gauge 22, and the storm water pump operation rules. The unit 11 acquires a water level change curve representing a water level change in the pump well or the like. The unit 11 acquires a pump discharge amount, the number of pumps to be operated, and a pump well water level from a current computation time to several computation periods afterward. The unit 11 supplies a command to a driver controller 23 if necessary. In accordance with the command, the controller 23 controls the pump driver 25 to change the number of pumps 24 to be operated.

As described above, the data processing unit 2 can determine rainfalls, pump well inflow rates, pump discharge amounts, the numbers of pumps to be operated, pump well water levels, or the like in a predetermined time (several computation periods) from a current time (current computation time). Therefore, the unit 2 can forecast an overall operation state of the pumps 24 and rapidly examine a countermeasure against a trouble if it forecasts that the trouble will happen.

An operation of the pump operation control apparatus having the above arrangement will be described below.

The radar transmitting/receiving unit **1*b* generates a transmission signal for each observation period determined by itself or on the basis of the command from the data processing unit 2. The unit 1*b* sends the generated transmission signal to the radar antenna 1*a*. Upon reception of the transmission signal, the antenna 1*a* transmits a radio wave in air. The antenna 1*a* receives the radio wave returned by backscattering by raindrops 3*a* in or falling from the rain cloud 3. The antenna 1*a* transmits the reception power data to the radar transmitting-/receiving unit lb. The unit 1*b* supplies the radar reception power data to the data calibrating unit 7 via the data transmitting units 4*a* and 4*b***.

The ground rain gages 5 located at a plurality of points measure actual rainfalls to obtain rainfall data. The rain gages 5 supply the obtained plurality of rainfall data to the data calibrating unit 7 via the transmitting units **6*a* and 6*b***.

Figure 2A:
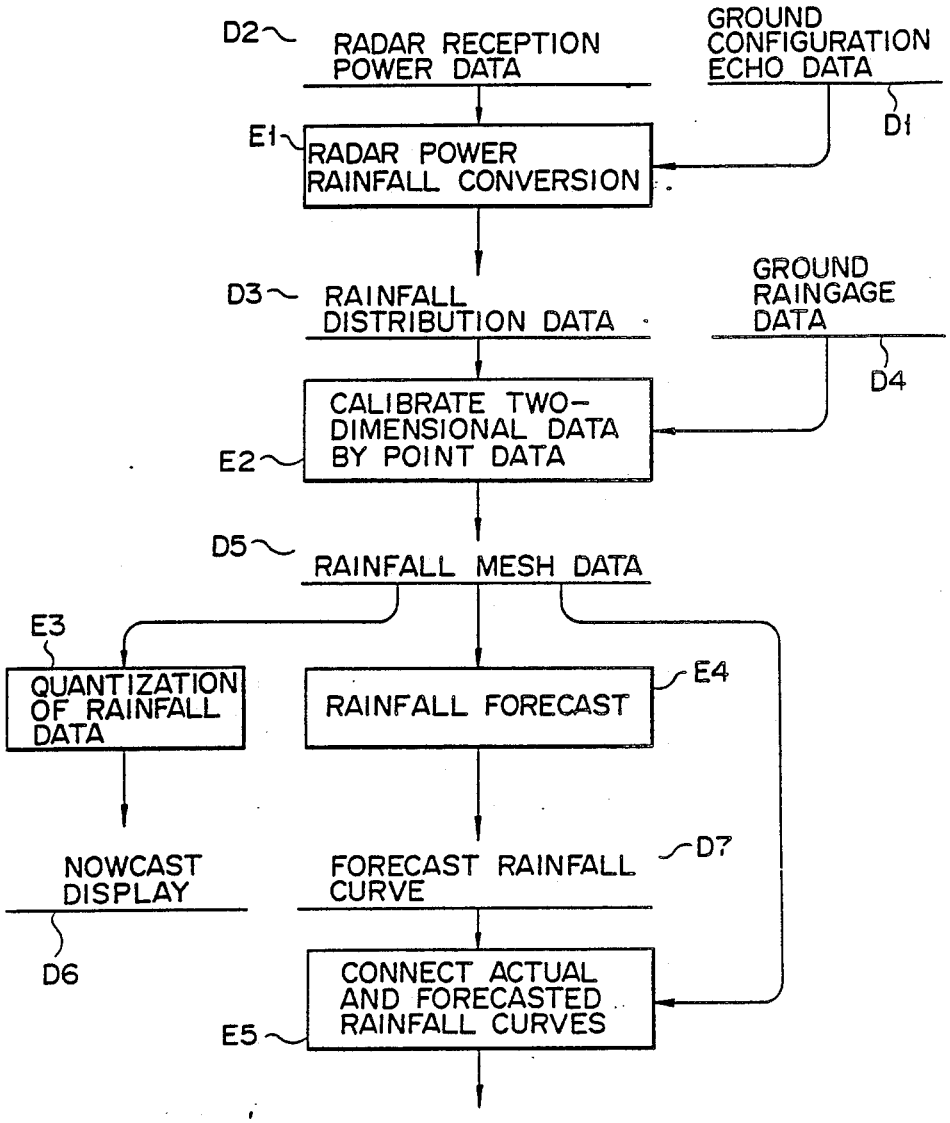
FIGS. 2A and 2B form a flow chart for explaining a series of data processing flow in a data processing unit.
Figure 2B:
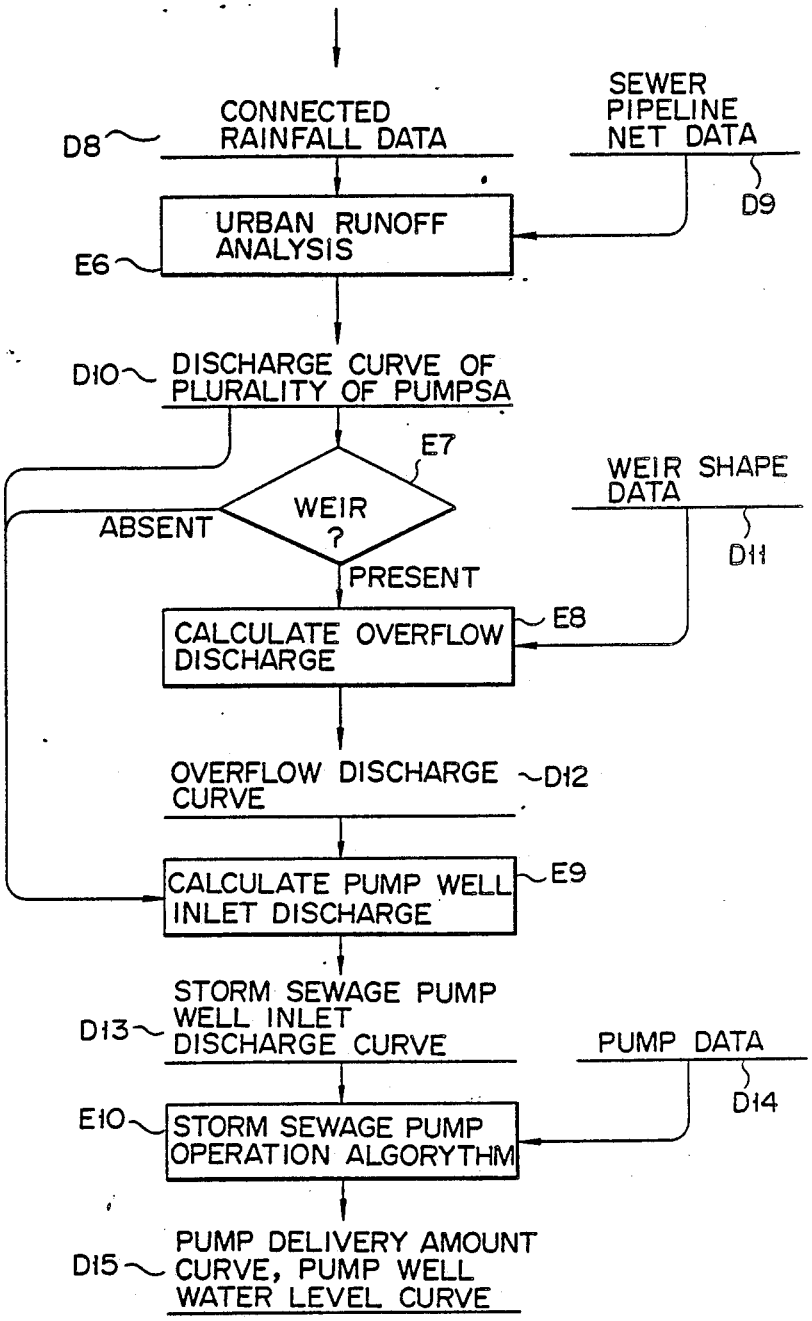

On the basis of the radar reception power data from the radar rain gage 1 and the rainfall data from the ground rain gages 5, the data processing unit 2 executes data processing in accordance with a flow chart shown in FIGS. 2A and 2B. An operation of the unit 2 will be described below with reference to FIGS. 2A and 2B. Referring to FIGS. 2A and 2B, each block represents an operation of the data processing unit and is denoted by reference symbol E, and an underlined portion represents data and is denoted by reference symbol D.

Step E1: The data calibrating unit 7 stores ground configuration echo data D1 obtained on a fine day in the memory unit **7*a*. The data D1 can be obtained by transmitting a radio wave from the radar antenna 1*a* and obtaining an intensity of the radio wave returned by bacKscattering by a surrounding configuration of the ground, buildings, or the like on a fine day. The unit 7 receives radar reception power data D2 from the radar raingage 1** and converts the data D2 into rainfall distribution data D3. Conversion from the data D2 into D3 is performed as follows. That is, the ground configuration data D1 is subtracted from the radar reception power data D2. As a result, an influence of a ground configuration echo is removed from the data D2. Since a functional relation is established between radar reception power Z and rainfall intensity R, the data D2 is converted into the rainfall distribution data D3 by using so-called radar equation $Z=a.R^b$ (where a and b are constants).

Step E2: The rainfall distribution data D3 obtained in step E1 is two-dimensional data concerning a wide area. The data calibrating unit 7 calibrates this two-dimensional data D3 by using the ground raingage data (point data) D4 representing the actual rainfalls from the ground rain gages 5. This calibration is performed by, e.g., correcting the constants a and b of the above radar equation such that the rainfall intensity R corresponds to the measurement values of the ground, rain gages 5.

Figure 4:
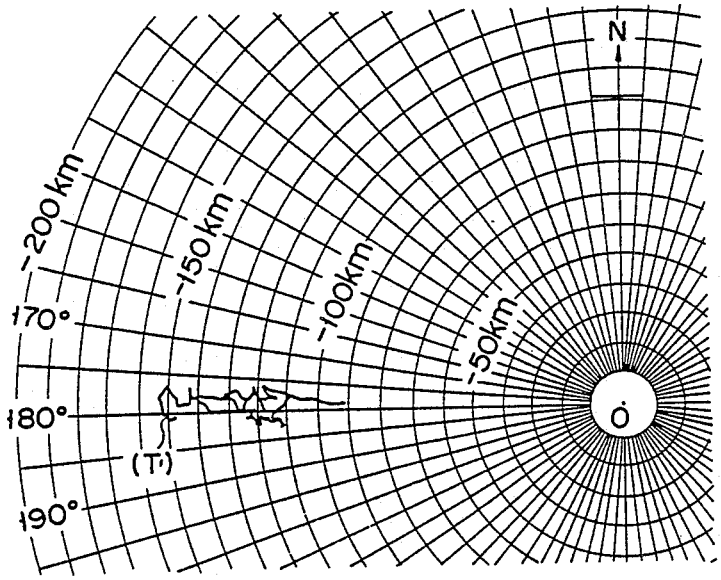
FIG. 4 is a view showing a mesh and a locus of a rainfall weighted centroid not having a predetermined moving direction.

The unit 7 then acquires rainfall mesh data D5. The data D5 represents rainfalls within a mesh obtained by dividing an area around the radar antenna **1*a*. More specifically, as shown in FIG. 4, assuming that the antenna 1*a* rotates 360° to observe rainfalls, the mesh is obtained by equally dividing the entire circumference of 360° into "128" or "256" sectors and drawing circles around the antenna 1*a*** in units of several kilometers.

Figure 3:
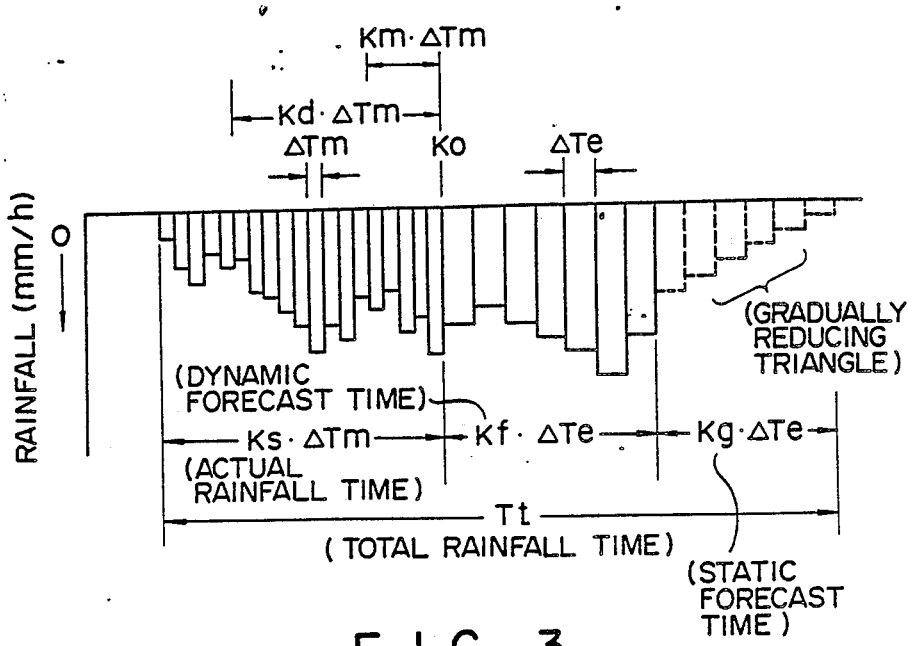
FIG. 3 is a graph showing a rainfall forecasted curve.

The unit 7 acquires the data D5 for each observation period (observation time unit width) ΔTm shown in FIG. 3. The unit 7 stores the acquired rainfall mesh data D5 in the memory unit **7*a*. The unit 7*a*** holds the data D5 from the past to the current time.

Step E3: It is difficult for an operator to understand a current rainfall distribution state directly from the rainfall mesh data D5. Therefore, the data calibrating unit 7 quantizes the data D5 so that a person can easily recognize the current rainfall distribution state. The unit 7 supplies the quantized rainfall mesh data to the display unit 8. The display unit 8 displays the quantized rainfall mesh data (Nowcast display D6).

Step E4: In this embodiment, pump operation control is updated for each computation period ΔTe independently of the observation period ΔTm. The rainfall forecasting unit 9 forecasts a future rainfall each time the computation period ΔTe elapses (at times ΔTe, 2·ΔTe, 3·ΔTe, . . . ). The unit 9 receives the data D5 from the calibrating unit 7 for each observation period ΔTm and stores the data D5 in the memory unit **9*a*. Therefore, the unit 9 stores at least the latest (Kd+1) sets (Kd=0, 1, 2, . . . ) of rainfall mesh data at a current computation time Ko in the memory unit 9*a*. On the basis of these sets of data, the unit 9** dynamically forecasts rainfalls at several times (Kf points) in several computation periods from the current time Ko, as shown in FIG. 3. If necessary, the unit 9 statically forecasts rainfalls at several times (Kg points) after the dynamic forecast times (meanings of dynamically and statically will be described later). A dynamic forecasting time is a time interval from the current computation time Ko to Kf·ΔTe, and a static forecasting time is a time interval from a time Ko+Kf·ΔTe to a time Ko+(Kf+Kg)·ΔTe. Referring to FIG. 3, assuming that the computation period ΔTe is ten minutes, the unit 9 dynamically forecasts rainfalls at six (Kf) points in an hour from the present and statically forecasts rainfalls at five (Kg) points thereafter.

A rainfall forecasting method differs in accordance with a rainfall expression method. Normal rainfall mesh data includes data representing rainfalls in several tens of thousands of meshes, e.g., its data amount is enormous. Therefore, it is almost impossible to directly use the rainfall mesh data D5 in rainfall forecast. For this reason, in this embodiment, the data D5 is statistically compressed in several types of data and used. This compression method includes (1) a first method in which a rainfall is represented by a weighted centroid and an average rainfall and (2) a second method in which a rainfall is represented by a total average rainfall. In the first method, a centroid of a rainfall distribution is obtained, and an average value of rainfalls is obtained for only meshes having rainfalls. In the second method, an average value of rainfalls is obtained for an entire area within a predetermined range around the radar antenna 1*a*.

Figure 5:
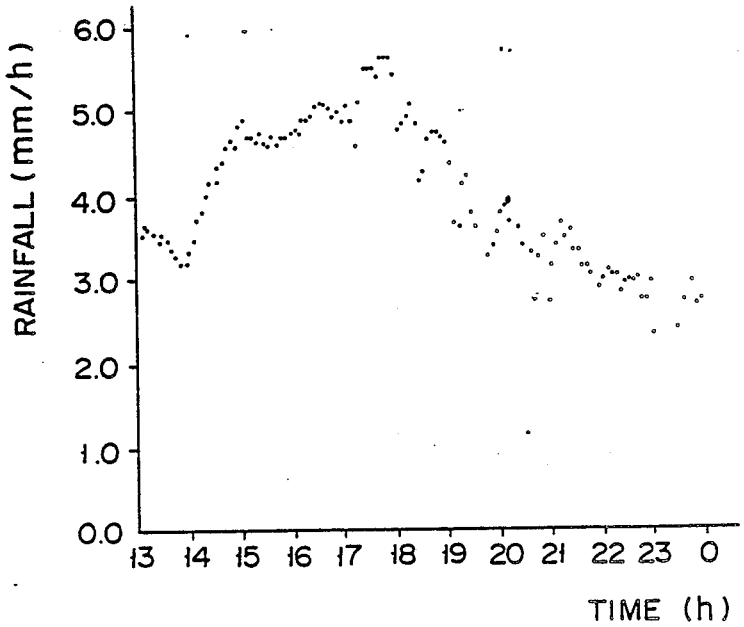
FIG. 5 is a graph showing a total area average rainfall.

FIG. 4 shows a locus of a centroid of the rainfall distribution, and FIG. 5 shows an average rainfall.

Figure 6:
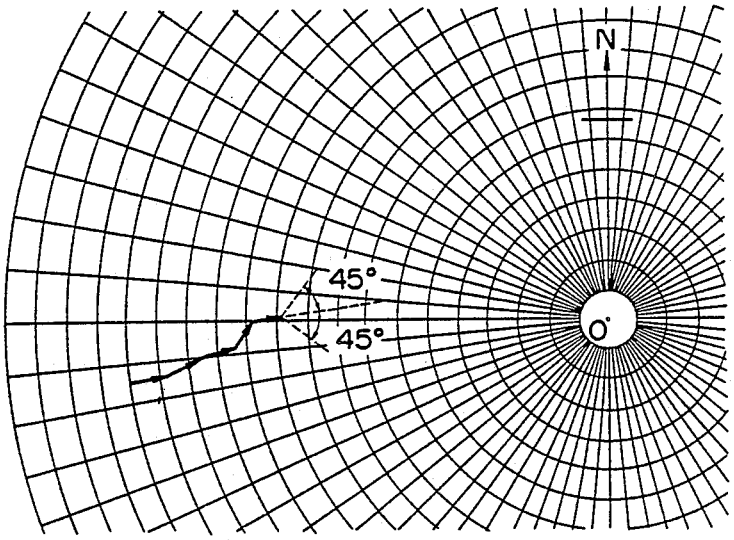
FIG. 6 is a view showing a mesh and a locus of a rainfall weighted centroid having a predetermined moving direction.

Referring to FIG. 4, reference symbol O represents a location of the radar antenna 1*a*, and reference symbol T represents a locus of the centroid on the mesh. The locus of the centroid has a wandering mode (W mode) in which the locus does not have a predetermined direction as shown in FIG. 4 and a forwarding mode (F mode) in which the locus moves forward in a predetermined direction as shown in FIG. 6. The locus of the centroid may sometimes be in the F mode at a certain time and then in the W mode or vice versa. In this embodiment, therefore, mode determination is performed each time the unit 9 forecasts a rainfall (each time the current computation time Ko shown in FIG. 3 is updated; each time the time ΔTe elapses) The unit 9 determines that the locus of the centroid is in the F mode when a bending angle $\alpha$ of a forward moving direction of the centroid continuously falls within the range of a predetermined angle (e.g., 45°) several times (e.g., three times). Otherwise, the unit 9 determines the W mode.

A detailed entire flow of a rainfall forecasting operation by the rainfall forecasting unit 9 will be described below with reference to FIG. 7. Rainfall forecast must be performed in consideration of the fact that a temporal and spatial change in rainfall does not repeat the past history (e.g., has characteristics without reproducibility). For this reason, the unit 9 (1) forecasts a rainfall by processing past data of a current rainfall, and (2) statistically forecasts a future position of the rainfall weighted centroid in consideration of the fact that the centroid wanders, thereby forecasting the rainfall. More specifically, for processing in the above item (1), the unit 9 processes Kd sets of mesh data Mt (t=Ko, Ko−ΔTm, . . . , KO−Kd·ΔTm) of a rainfall event at the current computation time Ko. For processing in the above item (2), in establishing rainfall forecast, the unit 9 calculates an average and variance of the positions of the centroid of the rainfall, and forecasts the position of the centroid within a predetermined time (dynamic forecast time) from the current computation time Ko assuming that a change in position of the rainfall centroid represents a normal distribution. When such a forecasting method is adopted, the number of mesh data sets to be processed for rainfall forecast is insufficient within a time ΔTm·Kd from a start time of a rainfall. Therefore, in this embodiment, a forecasting method (to be referred to as an I mode hereinafter) different from the above F and W modes is adopted within the time ΔTm·Kd (initial period) from the rainfall start time.

The rainfall forecasting operation will be described below with reference to FIGS. 7A and 7B. The rainfall forecasting unit 9 executes the flow shown in FIGS. 7A and 7B each time the predetermined computation period ΔTe has elapsed. In the following description, Ko represents a current computation time; Ks, the number of mesh data sets after rainfall starts; Kd, the number of mesh data sets to be processed for rainfall forecast; Km, the number of mesh data set to be processed for mode determination; Kf, the number of dynamic forecast times; Kg, the number of static forecast times; ΔTe, a computation period (or forecast period); and ΔTm, an observation period.

Figure 8:
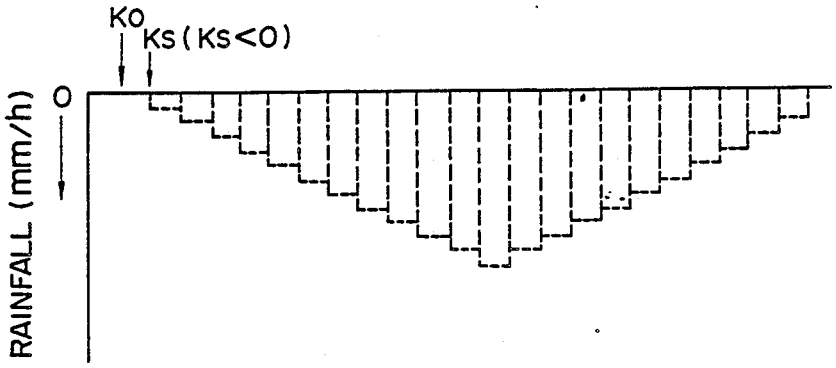
FIG. 8 is a graph showing a rainfall curve obtained when a period before a rainfall starts is a computation time.

The unit 9 receives static forecast of a total rainfall Rt and a rainfall time Tt concerning a current rainfall event from an external unit (or an input by an operator) (step S1). The static forecast means forecast representing that, e.g., 200 (Rt) mm of a rain falls within 8 (Tt) hours from a certain time. In this static forecast, rainfall forecast carried out by the Meteorological Agency can be utilized. Alteratively, a manager of the system can personally acquire such data. The unit 9 then checks whether Kd sets of rainfall mesh data are already obtained. If the Kd sets of mesh data are not obtained yet, the unit 9 determines the I mode, and the flow advances to step S3. In step S3, the unit 9 checks whether a rain is already falling. If a rain has not fallen yet, an actual rainfall is zero, and the flow advances to step S4. The unit 9 forms an inverted-isosceles-triangular rainfall curve as shown in FIG. 8 on the basis of the total rainfall Rt and the rainfall time Tt (step S4). In FIG. 8, the number of sections representing the maximum value in the maximum rainfall curve is two when a value obtained by dividing the rainfall time Tt by the computation period ΔTe is an even number, and is one when the value is an odd number. The maximum rainfall is obtained as follow:

if Tt/ΔTe=2 m maximum rainfall=Rt/(m+1) (two sections)

if Tt/ΔTe=2 m−1 maximum rainfall=Rt/m (one section)

If the unit 9 determines in step S3 that the current computation time Ko is after the rainfall start time, the flow advances to step S5. In this case, a predetermined number of mesh data sets are not obtained yet (0<Ks<Kd). In this case, since actual rainfalls At (t=Ko, Ko−ΔTm, Ko−2·ΔTm, . . . , Ko=Ks·ΔTm) of Ks sets are obtained, an actual rainfall sum S represented by the following equation is subtracted from the total rainfall Rt in step S5:

$$S = \sum_{t=Ko-Ks\cdot\Delta Tm}^{t=Ko} At$$

Figure 9:
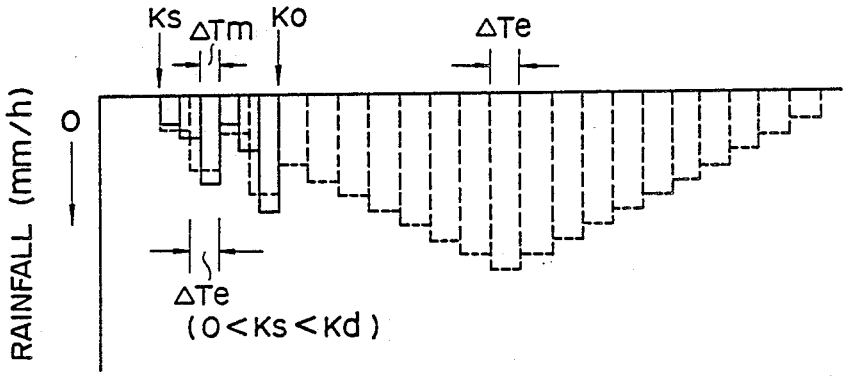
FIG. 9 is a graph showing a rainfall curve obtained when a period after a rainfall starts and before a predetermined number of data sets are obtained is a computation time.

The rainfall time is obtained by subtracting Ks·ΔTm from Tt. On the basis of the obtained data, the unit 9 forms an isosceles-triangular rainfall curve and obtains a rainfall curve combining the actual and forecast data as indicated by a dotted line in FIG. 9.

When a predetermined period Kd·ΔTm has elapsed from rainfall start time and a predetermined number of processing data sets Kd are obtained, the flow advances from step S2 to S7. The unit 9 checKs at the current computation time Ko whether the locus of the centroid is in the F or W mode. The unit 9 performs different data processing in accordance with the determination result. Basically, data processing is performed on the basis of the following three heuristics in either mode.

(1) A moving vector of the centroid is calculated from the locus of the centroid.

(2) A rate of change (increase/decrease rate) with respect to a rainfall time is calculated.

(3) A rainfall distribution state at the current computation time Ko is assumed to be unchangeable in a dynamic forecast time.

Figure 7A:
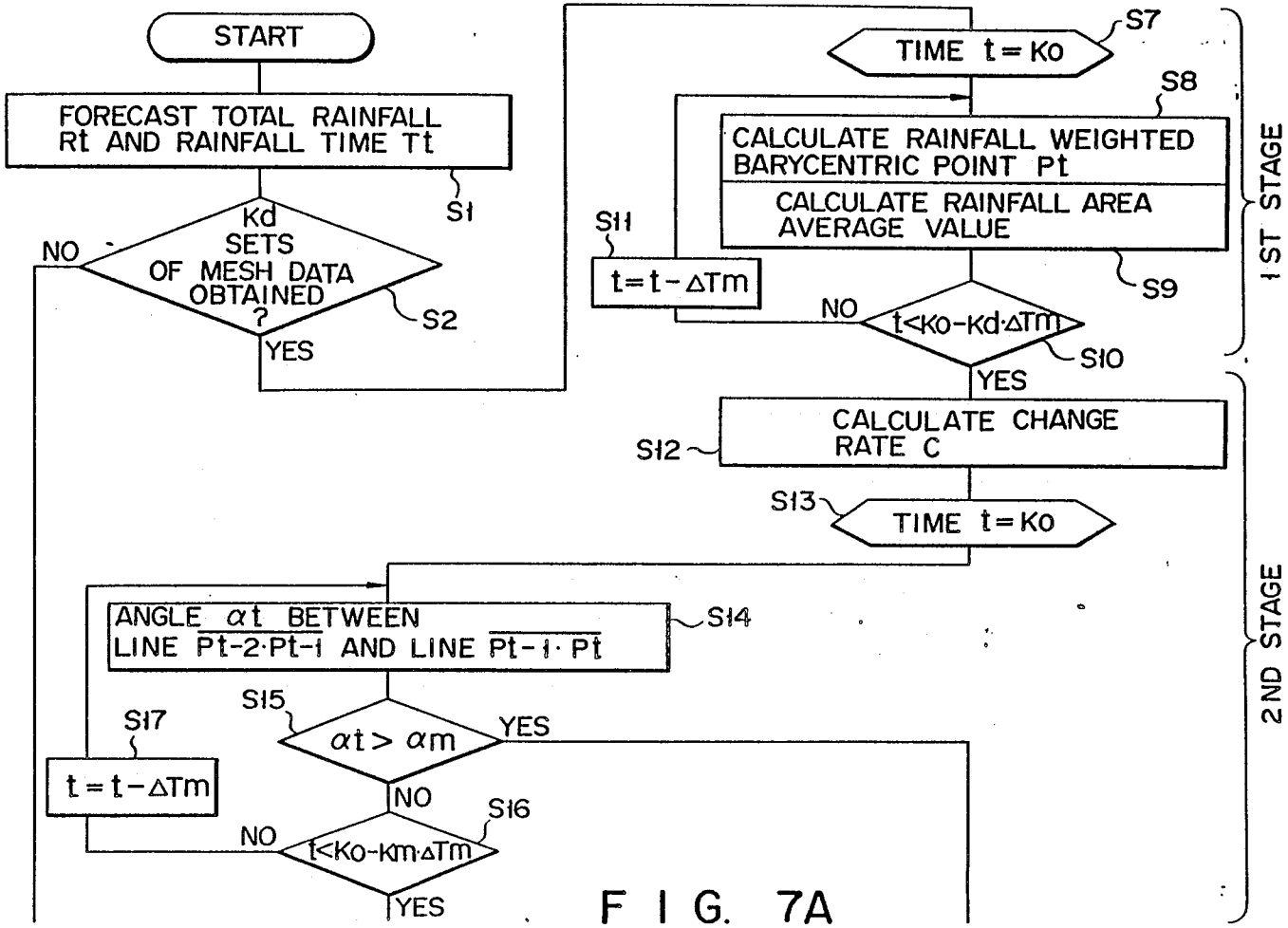
FIGS. 7A and 7B form a flow chart for explaining computation processing in a rainfall forecasting unit.
Figure 7B:
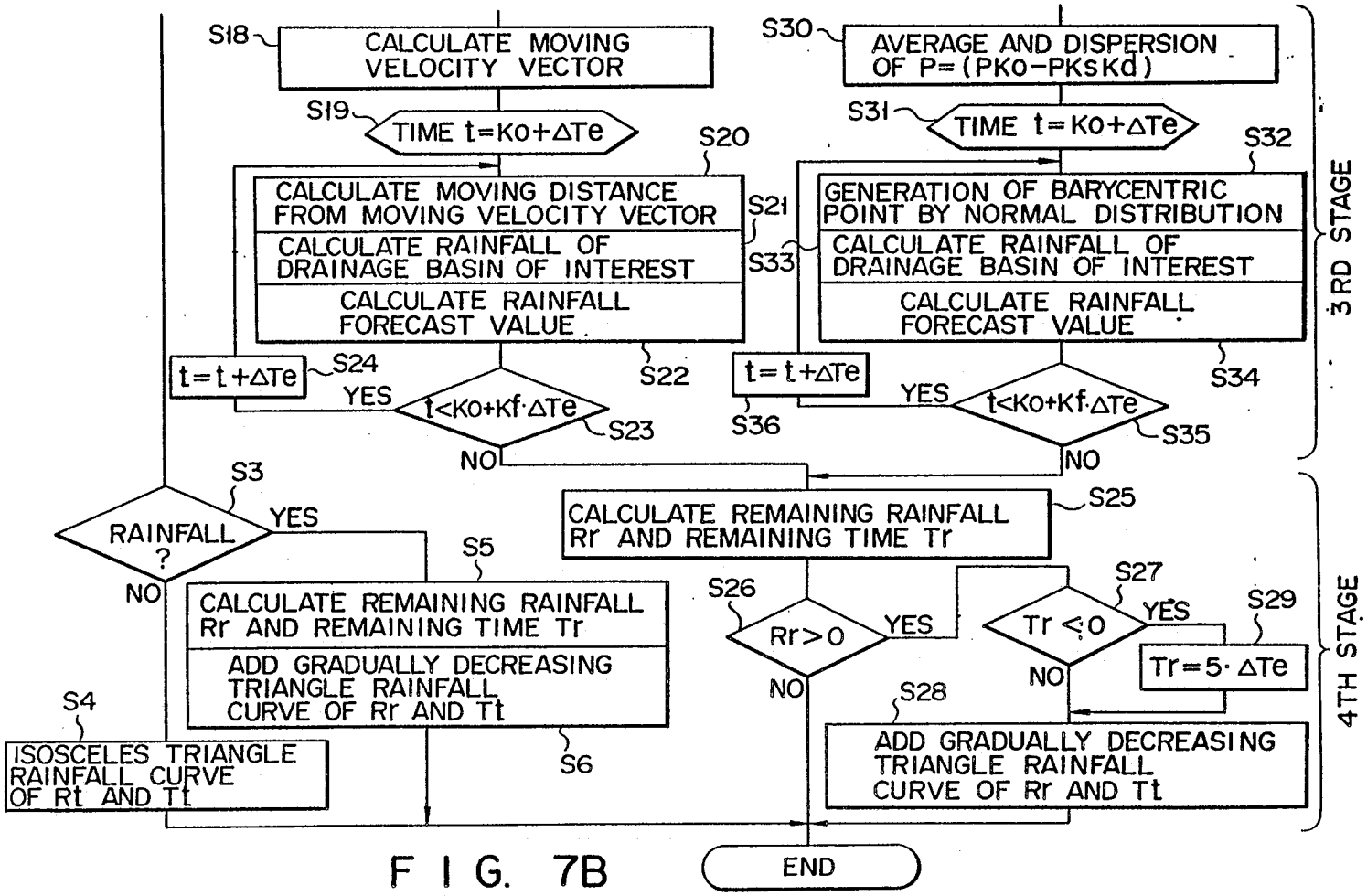

The rainfall forecast processing other than that in the I mode can be classified into first to fourth stages as shown in FIGS. 7A and 7B. The first to fourth processing stages will be described below in the order named.

In step S7, a time t is set at Ko (current computation time). In steps S8 and S9, a position Pt of the rainfall weighted centroid and a rainfall area average value At of a rainfall distribution Mt at the current computation time Ko are calculated. The position Pt of the rainfall weighted centroid and the rainfall area average value At are used in calculations of a centroid moving vector and a rainfall change rate to be described later. The position Pt of the rainfall weighted centroid is located in a two-dimensional plane, so that it can be expressed by two components. With respect to each component, the coordinates of the central point of each mesh are multiplied with both the area of that mesh and the rainfall in that mesh, and then the multiplied coordinates are added together to obtain a sum corresponding to all meshes. Likewise, with respect to each component, the coordinates of the central point of each mesh are multiplied with the surface area of that mesh, and then the multiplied coordinates are added together to obtain a sum corresponding to all meshes. The position PT of the rainfall weighted centroid can be obtained by dividing the former sum with the later sum. The rainfall area average value At is obtained by calculating an average value of rainfalls of meshes having a rainfall other than 0.

When calculations of Pt and At at the current computation time Ko are finished, the unit 9 checks in step S10 whether Kd sets of past Pt and At values are already obtained. If in step S10, ΔTm is subtracted from the time t (step S11). Steps S8 and S9 are executed to obtain Pt and Kd at an immediately preceding observation time Ko−ΔTm. The above operation is repeatedly performed. When Kd sets of Pt and At values are obtained, the operation advances to step S12.

In step S12, the unit 9 calculates a change rate c of the rainfall area average value in accordance with the following equation by using the Kd sets of the centroid Pt and average values At:

$$c = \{1/(Km-1)\} \sum_{t=Ko}^{t=Ko-(Km+1)\cdot\Delta Tm} (1 - A_{t-\Delta Tm}/A_t)$$

In step S13, the time t is reset to the current computation time Ko. Subsequently, in step S14, the above moving velocity vector is generated. The moving velocity vector is obtained as follows. An angle $\alpha_t$ of a line segment $P_{t-\Delta Tm}\cdot P_t$ (the position of the centroid at the current computation time) with respect to a line segment $P_{t-2\cdot\Delta Tm}$ (the position of the centroid at the second previous observation time with respect to the time t) $P_{t-\Delta Tm}$ (the position of the centroid at an observation time immediately preceding to the time t) is calculated. The unit 9 performs mode determination on the basis of an angle αt and a mode branch angle αm (step S15). If αt>αm, the unit 9 determines the W (wandering) mode, and the flow advances to step S30 to be described later. If αt≦αm, the operation advances to step S16. In step S16, the unit 9 checks whether the time t is earlier than the current computation time Ko by the time Km·ΔTm, i.e., whether determination in step S15 is performed for all the past Km observation times. If N in step S16, ΔTm is subtracted from the time t (step S17), and the operation returns to step S14. Thereafter, the above processing is executed. There is at least one case wherein αt>αm in the Km immediately preceding observation times, the W mode is determined, and the operation advances to step S30. If the case of αt>αm is not present in the Km immediately preceding observation times, the centroid is moving substantially straight, and the F mode is determined. The operation advances to step S18

Figure 10:
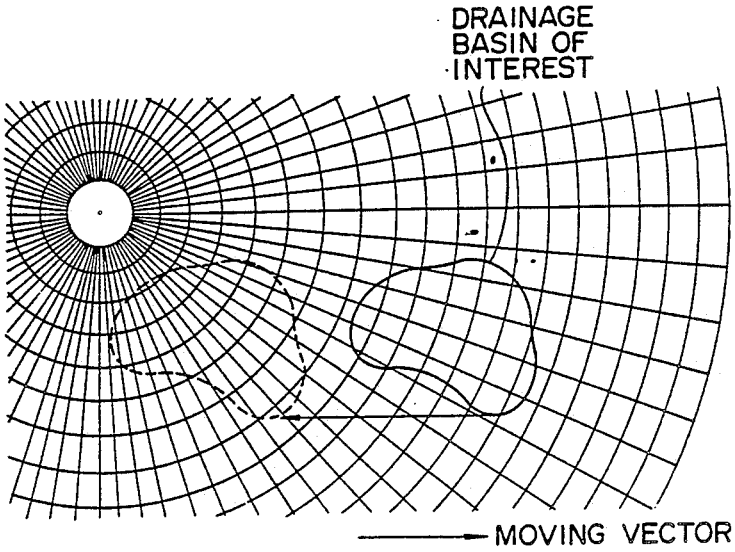
FIG. 10 is a view showing a relationship between a moving vector and a drainage basin of interest obtained when a rainfall of the drainage basin of interest is calculated on the basis of a rainfall distribution.

In step S18, the unit 9 calculates a moving velocity vector $P_{t-3\cdot\Delta Tm}\cdot Pt/(3\cdot\Delta Tm)$ assumed to be constant in a dynamic forecast time The moving velocity vector represents a moving direction and a moving amount per unit time of the centroid Pt. In step S19, the time t is set to be an initial forecast time $t=Ko+\Delta Te$. A rainfall distribution MKo at the current computation time Ko is forecasted to move in the direction of the moving velocity vector by the magnitude thereof per unit time Therefore, in step S20, the moving velocity vector is multiplied by ΔTe to obtain a moving distance of the centroid to the next forecast time (computation time). The rainfall distribution MKo is parallelly moved by the moving distance obtained in step S20 as a rainfall distribution at the forecast time Ko+ΔTe. FIG. 10 shows the moved rainfall distribution. A rainfall in each mesh of the drainage basin of interest is calculated on the basis of the moved rainfall distribution (step S21). The rainfall obtained in step S21 is multiplied by the change rate c to calculate a rainfall forecast value rt (step S22). In step S22, the unit 9 checks whether the above operation is performed for all the Kf forecast times. If N in step S22 (i.e., if t<Ko+Kf·ΔTm), ΔTe is added to the time T. The above operation is repeated. If the unit 9 determines in step S23 that the above operation is performed for all the Kf forecast times, the operation advances to step S25.

When the sum of the actual rainfall time Ks·ΔTm and the dynamic forecast time Kf·ΔTe is smaller than the rainfall time Tt or when the actual rainfall sum GW and the dynamic forecast rainfall sum JW are smaller than the total rainfall Rt, a remaining time Tr and a remaining rainfall Rr are calculated by the following equation in step S25:

$$GW = \sum_{t=Ko-Ks\cdot\Delta Tm}^{t=Ko} At$$

$$JW = \sum_{t=Ko+\Delta Te}^{t=Ko+Kf\cdot\Delta Te} rt$$

$$Tr = Tt - Ks\,\Delta Tm - Kf\cdot\Delta Te$$

$$Rr = Rt - \sum_{t=Ko-Ks\cdot\Delta Tm}^{t=Ko} At - \sum_{t=Ko+\Delta Te}^{t=Ko+Kf\cdot\Delta Te} rt$$

In step S26, whether Rr>0 is checked If Rr>0, the processing is finished If Rr>0, the operation advances to step S27. In step S27, whether Tr<0 is checked. If Tr≧0, the operation advances to step S28, and a triangular rainfall curve in which the remaining time Tr and the remaining rainfall Rf are gradually decreased as shown in FIG. 3 is generated. This is called static forecast A forecast point number (the number of forecast times) Kq of static forecast is obtained as Kq=INT (Tr/ΔTe). INT(x) means an integral part of x. If Rr is positive and Tr is negative, Tr=5·ΔTe is set in step S29 to generate a triangular rainfall curve in which a rainfall is gradually decreased. In this manner, the operation of obtaining the rainfall forecast curve D7 in the F mode is finished. The operation flow returns to step E5 in FIG. 2A.

In step S15, if the angle αt (t=Ko, Ko−ΔTm, . . . , Ko−Km·ΔTm) is larger than the angle αm, the W mode is determined. The operation advances to step S30. In step S30, an average value Pa and variance op of the positions (coordinates) of the centroid Pt (t=Ko, Ko−ΔTm, . . . , KO−Kd·ΔTm) at the current and past Kd forecast points are calculated. The calculated average values Pa and variances op are used as constants of a normal distribution in a process of establishing rainfall forecast In step S31, the time t is set at Ko+ΔTe. In step S32, the position of the centroid at the forecast time t=Ko+ΔTe is obtained. In this case, assuming that changes in centroid position are normally distributed, the position of the centroid Pt is calculated on the basis of a normal distribution N(Pa, op) by using a Monte Carlo method (step S33). A moving velocity vector from $P_t$ to $P_{t+\Delta Te}$ is calculated from the obtained centroid position. The rainfall distribution MKo is moved on the basis of the calculated moving velocity vector (step S33). Similar to step S22, the rainfall is multiplied by the change rate c to calculate the rainfall forecast value rt (step S34). In step S35, the unit 9 checks whether forecast is completely performed for all the Kf dynamic forecast points. If any forecast point still remains, ΔTe is added to the time t in step S36. Thereafter, an operation of steps S32 to S35 is repeated. When the processing is completely performed for all the forecast times $t=Ko+\Delta Te\cdot K$ ($K=1, 2, \ldots, Kf$), the flow advances to step S25. Thereafter, an operation similar to that in the F mode is performed. In this manner, dynamic and static forecasts of rainfalls in the W mode are obtained The rainfall forecasting operation has been described with reference to FIGS. 7A and 7B. The description will return to the flow chart in FIGS. 2A and 2B.

Step E5: When the rainfall forecast curve D7 of the drainage basin of interest shown in FIG. 3 is obtained, the actual rainfall curve and the curve D7 are connected with each other as follows. In order to perform this connecting processing, the actual rainfall curve (represented by a set of rectangles each having a width of ΔTm) must be rewritten into a set of rectangles each having a width of the computation period ΔTe. A portion satisfying $t=ts+u\cdot\Delta Tm+te$ will be described. In this equation, ts is the first time, te is the last time, 0=ts, te≦ΔTm, and u is a positive integer including zero. Assuming that rainfalls at ts, u·ΔT, and te are gs, gj (j=1, 2, . . . , u), and ge, respectively, a corrected actual rainfall ga of this portion is given as follows:

$$ga = \left(gs\cdot\frac{ts}{\Delta Tm} + \sum_{j=1}^{u} gj + ge\cdot\frac{te}{\Delta Tm}\right)/\Delta Te$$

When u=0, $$\text{When } u = 0,$$
$$= \left(gs\cdot\frac{ts}{\Delta Tm} + ge\cdot\frac{te}{\Delta Tm}\right)/\Delta Te$$

is obtained.

The obtained connected rainfall curve data D8 is supplied to the runoff analyzing unit 10.

Step E6: The runoff analyzing unit 10 receives the connected rainfall curve data D8 from the rainfall forecasting unit 9. The unit 10 stores data D9 concerning a sewer pipeline network. The unit 10 performs runoff analysis corresponding to drainage basis characteristics of the urban area of interest by using the connected rainfall curve data D8 and the sewer pipeline network data D9. The rainfall forecast unit 9 calculates a discharge of storm sewage on the basis of the runoff analysis, thereby obtaining a discharge of water flowing into the pump well 21. In this embodiment, a storm water flow [$m^3$/s] of an urban drainage basin of interest [$m^2$] is obtained from a connected rainfall [mm/h]. A runoff analyzing method for converting a rainfall into a flow is conventionally used mainly in order to prevent a flood of rivers. The conventional runoff analyzing method is established on the basis of an assumption that a rainfall permeates in the ground, stays therein, and then flows. In a recent urban area in which houses are crowded and streets are paved, however, a rainfall does not permeate in the ground but immediately flows in a drainage basin. Runoff analysis in such an area is called urban runoff analysis so as to be distinguished from the runoff analyzing method focusing previousness in the ground.

The urban runoff analyzing method includes a macroscopic hydrological method and a microscopic hydraulic method. The hydrological method calculates only a flow and therefore is suitable for runoff analysis of a complicated sewer pipeline network. The hydraulic method calculates a flow on the basis of a flow and a pressure and therefore is not suitable for runoff analysis of a complicated sewer pipeline network. The hydraulic method is suited to a simple trunk piping. In this embodiment, therefore, the macroscopic hydrological method handling only a discharge is used as the runoff analyzing method. The macroscopic hydrologic method includes several methods. One of the methods is an RRL (Road Research Laboratory) method. The RRL method calculates a flow at the most downstream point of a drainage basin of interest. The RRL method is disclosed in Journal of the HYDRAULICS DIVISION November 1969, pp. 1809–1834 and is known.

Figure 11:
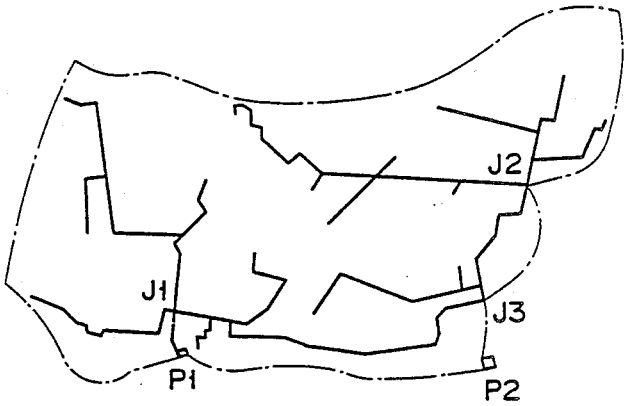

For better understanding, a drainage basin of an urban area having a sewer pipeline network shown in FIG. 11 will be described. In this drainage basin, a plurality of pipe junctions $J_1$ to $J_3$, pump sites $P_1$ and $P_2$, and the like are located. At the junction $J_1$ in this drainage basin, storm water corrected from sewer pipes on the upstream is divided to the pump site $P_1$ and the junction $J_3$. At the junction $J_3$, storm water components from the junctions $J_1$ and $J_2$ are combined and flowed to the pump site $P_2$. In order to calculate a flow at the most downstream point by using the RRL method, three partial drainage basins having the junctions $J_1$ to $J_3$ as the most downstream points, respectively, will be described. The rainfall forecast unit 9 forms a curve representing flow changes in sewer pipes divided at the junctions $J_1$ to $J_3$. A flow of water flowing through the junction $J_3$ via the junctions $J_1$ and $J_2$ must be considered for the discharge at the junction $J_3$. For this reason, in order to obtain the flow at the junction $J_3$, water transfer times between the junctions $J_1$–$J_3$ and $J_2$–$J_3$ and confluence of water of the two routes must be considered. Therefore, in this runoff analysis, (1) a transfer time must be calculated in the case of a sewer pipeline network not including a storm water overflow weir and (2) a positional relationship representing the upstream or downstream of each junction must be considered to calculate a flow. The water transfer time between the two junctions is obtained by fluid analysis in a pipe. Many of transfer time calculations are flow analysis of an open channel and can be obtained by solving a nonlinear hyperbolic partial differential equation. This equation includes an equation concerning a uniform flow not considering time and areal variations, an equation concerning a non-uniform flow not considering a time variation, and an equation concerning an unsteady flow considering the both. Since only a flow is handled and a computation period for a pump operation is five or ten minutes, i.e., comparatively short, however, it is preferred to solve the nonlinear hyperbolic partial differential equation assuming that a fluid is a uniform flow.

Figure 12:
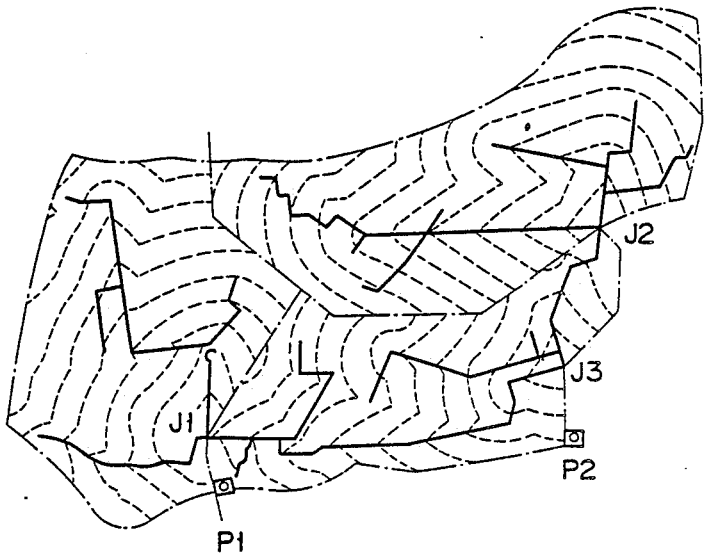
FIGS. 11 and 12 are views showing a vertical arrangement of a sewer pipeline network of the drainage basin of interest.

A method of analyzing a discharge in a sewer pipe in consideration of the upstream/downstream relationship of the junctions will be described below. For example, when the basic RRL method is to be used, a drainage basin of interest is divided into three drainage basins having the junctions $J_1$ to $J_3$ as the most downstream points, respectively, as indicated by an alternate long and short dashed line in FIG. 12. Times required for water at the respective points to reach the junctions $J_1$ to $J_3$ are calculated. Points at which reaching times are multiples of the computation period are connected to form an equal reaching time curve as indicated by a broken line in FIG. 12. Areas of three portions encircled by alternate long an short dashed lines are calculated to form a relationship between the reaching times and areas. A curve representing a flow change is formed by using the rainfall curve on the basis of the relationship between the reaching times and the areas.

Figure 13:
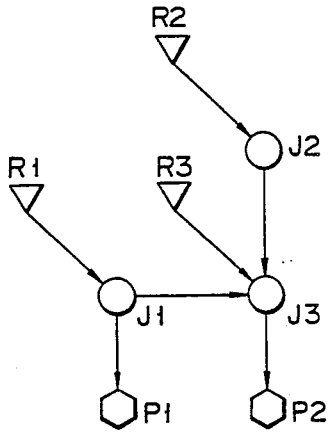
FIG. 13 is a view showing a relationship between the runoff analysis result and the sewer pipeline network.
Figures 14, 15:
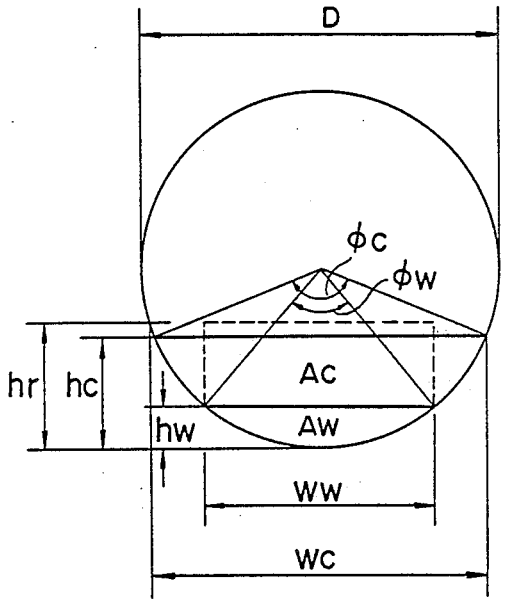
FIG. 14 is a view for explaining a computation performed while the vertical arrangement of the sewer pipeline network is maintained.
FIG. 15 is a view for explaining an overflow discharge calculation as a water level calculation performed when an artificial structure such as a weir is added to the sewer pipeline network.

This operation will be described in detail below with reference to FIG. 13. As shown in FIG. 13, flow curves (discharge curves) $R_1$ to $R_3$ obtained from the urban runoff analysis result flow along directed branches indicated by arrows to the sewer pipeline network including the junctions $J_1$ to $J_3$, the pump sites $P_1$ and $P_2$, and the like. Assuming that $R_1$ to $R_3$ are output nodes, $J_1$ to $J_3$ are input/output nodes, and $P_1$ and $P_2$ are input nodes, storm water components flow from the output nodes $R_1$ to $R_3$ as the flow curves to the input/output nodes $J_1$ to $J_3$, respectively. The input branch from the node $R_1$ and the output branches to the nodes $P_1$ and $J_3$ are connected to the input/output node $J_1$. Therefore, this sewer pipeline network is constituted by the input nodes $P_1$ and $P_2$, the nodes $R_1$ to $R_3$ having the output branches, and the nodes $J_1$ to $J_3$ having the input and output branches. In order to calculate a flow in consideration of a vertical relationship between the nodes, a table representing a node connection relationship is formed as shown in FIG. 14. In this node connection relationship table, the input/output nodes $J_1$ to $J_3$ and the input nodes $P_1$ and $P_2$ are arranged from the left to right in the uppermost row, the input/output nodes $J_1$ to $J_3$ and the output nodes $R_1$ to $R_3$ are arranged from the upper to the lower rows in the leftmost column, and "1"s are written in portions in a mutual connection relationship. FIG. 14 represents that a flow can be calculated by calculating $R_1$ for the node $J_1$, calculating $R_2$ for the node $J_2$, and calculating $R_3$ for the node $J_3$ because $J_1$ and $J_2$ are already calculated. In addition, a flow at the node $J_1$ is already calculated for the node $P_1$, and a flow at the node $J_3$ is already calculated for the node $P_2$. Therefore, in this sewer pipeline network, a flow can be obtained by sequentially executing calculations in an order of the nodes $J_1$, $J_2$, $J_3$, $P_1$, and $P_2$. The output nodes $R_1$ to $R_3$ can be independently calculated because they have no inputs. After the output node Ri ($i=1$, 2, and 3) is calculated, flows at the nodes $J_1$, $J_2$, $J_3$, $P_1$, and $P_2$ are calculated on the basis of the above connection relationship. When a large number of input nodes are present, it is sometimes effective to assign numbers to input nodes without considering a vertical relationship. In this case, a computation is executed in an arrangement order such that a computation of an input node including an unoperated output node is not executed and a computation of the next input node is executed. After the computation is executed to the end, a computation is executed again for unoperated input nodes in the arrangement order. By repeatedly executing this computation, flow curves of all the input nodes can be formed while the vertical relationship is satisfied because the directed branches are handled.

The runoff analyzing unit 10 checks whether the sewer pipe has a weir (step E7). If the sewer pipe does not have a weir, the operation advances to step E9. If the sewer pipe has a weir, the operation advances to step E8.

Step E8: Runoff analysis of a sewer pipeline network having a storm water overflow weir (including a step, an orifice, or the like) will be described. In this case, the runoff analyzing unit 10 stores data D11 concerning the shape of a sewer pipe beforehand. The storm water overflow weir is often used at a confluent point of sewer pipes. The storm water overflow weir supplies a water flow in an amount for a fine day to a treatment plant. When the flow amount is increased upon rainfall, the storm water overflow weir overflows water exceeding a certain water level to a frontage path and flows it directly to a river. When the water level in the pipe becomes higher than the height of the weir, water in the pipe overflows. Therefore, a flow of an overflow must be calculated. Generally, in order to easily measure the flow, a weir has a triangular or rectangular section, and the flow is calculated from its water depth. For this reason, a flow of water flowing out from such a weir can be easily calculated. In a sewer pipe 30 having a circular section shown in FIG. 15, a flow of overflow discharge is calculated under the following two conditions. In the first conditions, a depth hr is calculated assuming that the sewer pipe 30 having a circular section is a full-width weir having a rectangular section. In the second condition, assuming that an equal area condition is established, the depth hr of a rectangular section is converted into a depth hc of a circular section, thereby calculating a flow. This will be described in more detail below. In the circular section shown in FIG. 15, a full-width weir height is hw, a weir width is Ww, and a weir sectional area is Aw. Under these conditions, a rectangular section indicated by a dotted line and having a longer side equal to the weir width hw and a shorter side equal to the full-width weir height hw can be assumed. A discharge Qw for such a weir is given as follows by using the Francis formula:

$$Qw = 1.84 Wwhr^{\frac{3}{2}}$$

Assuming that a pipe diameter is D, $$Ww = D\sin(\phi w/2)$$

$$hw = d/2\{1 - \cos(\phi w/2)\}$$

$$Aw = (D/2)^2 \cdot \{(\phi w/2) - (\sin\phi w/2)\}$$

are established. Assuming that the equal area condition as the second condition is established, the following equation is obtained by adding a suffix c to each amount:

$$Ww \cdot hr + Aw = Ac = (D/2)^2 \cdot \{(\phi c/2) - (\sin\phi c/2)\}$$

Therefore, since the above c can be obtained by repeatedly executing computations by using a Newton's method, a critical depth hc can be obtained by the following equation:

$$hc = (D/2) \cdot \{1 - \cos(\phi c/2)\} - hw$$

A discharge Q of a fluid flowing through a sewer pipe can be calculated on the basis of the critical depth hc.

The discharge Q obtained by the runoff analysis is branched into weir overflow discharge Qw and a discharge Qt flowing to a treatment plant. A detailed calculation must be performed in accordance with a pipe structure specification. When a branch point is separated from a control section, a water surface shape calculation based on non-uniform flow analysis is performed. This calculation is performed in accordance with the following six steps. (1) Longitudinal and cross-sectional shapes of a channel are drawn. (2) Control depths h of a weir, a step, and an orifice of an artificial structure are calculated. (3) A uniform flow depth ho is calculated. (4) A critical depth hc is calculated. (5) A flow state is determined. (6) A water surface shape is tracked from the control depth h as a start point to the upstream in the case of a subcritical flow and to the downstream in the case of a super critical. The flow states are as listed in Table 1.

TABLE 1

| State | Classification | (Symbol Representing) Water Surface Shape |
|---|---|---|
| Subcritical Flow | Backwater | M1, C1, S1 |
| Subcritical Flow | Sinking Backwater | M2, H2, A2 |
| Super Critical Flow | Backwater | M3, C3, S3, H3, A3 |
| Super Critical Flow | Sinking Backwater | S2 |
| Critical Flow | Uniform | C2 |

TABLE 1-continued

| State | Classification | (Symbol Representing) Water Surface Shape |
|---|---|---|
| Flow | Flow | |

That is, although the flow state includes a subcritical flow, a super critical, and a critical flow (uniform flow) as shown in Table 1, it can be classified into five flows in consideration of the control depth h, the uniform flow depth ho, the critical depth hc, and the like depending on a flow, a gradient, a sectional shape, and the like. The water surface shape can be classified as listed in Table 2. This complicated calculation is performed for only a predetermined pipe portion. For this reason, the flow Qw to be branched in accordance with the flow state is calculated in advance by using an interactive computer while the flow is changed within a certain range. The runoff analyzing unit 10 calculates an overflow weir flow on the basis of relationship between the flow Qw calculated and stored beforehand, the branch flow Qw, and the treatment plant flow Qt.

Step E9: As described above, when the relationship between the flow Q and the flow Qw and Qt is predetermined, an inlet flow of storm water into a pump well can be obtained by subtracting the branch flow Qw from the flow Q.

In the above processing steps, a flow obtained when rain falls and rain water flows to a pump site via a sewer pipeline network and then into the pump well 21 is calculated. By calculating a flow at each forecast time, a curve D13 representing a change in flow of storm water flowing in the pump well is obtained.

TABLE 2

| Water Surface Shape | Relationship between h, ho, and hc | Channel Classification |
|---|---|---|
| M1 | h > ho > hc | Moderate Gradient |
| M2 | ho > h > hc | i > 0 |
| M3 | ho > h > h | ho > hc |
| S1 | h > hc > ho | Steep Gradient |
| S2 | hc > h > ho | i > 0 |
| S3 | hc > ho > h | hc > ho |
| C1 | h > hc = ho | Critical Gradient |
| C2 | h = hc = ho | i > 0 |
| C3 | hc = ho > h | hc > ho |
| A2 | h > hc | Reverse Gradient |
| A3 | hc > h | i < 0 |
| H2 | ho→ ∞, h > hc | Horizontal |
| H3 | ho→ ∞, hc > h | i = 0 |

Step E10: The storm water pump well inlet flow curve data obtained by the runoff analyzing unit 10 as described above is supplied to the pump number determining unit 11. The unit 11 calculates a pump delivery amount curve and a pump well water level curve D15 in accordance with a storm water pump operation algorithm by using the storm water pump well inlet flow curve D13 and data D14 concerning the pump. The unit 11 determines the number of pumps to be operated in accordance with the obtained pump delivery amount curve and pump well water level curve. The pump well 21 includes a plurality of storm sewage pumps 24 having the same rating and the water level gauge 22. Each pump 24 is driven by a pump driver 25 such as a motor or a prime mover.

Figure 16:
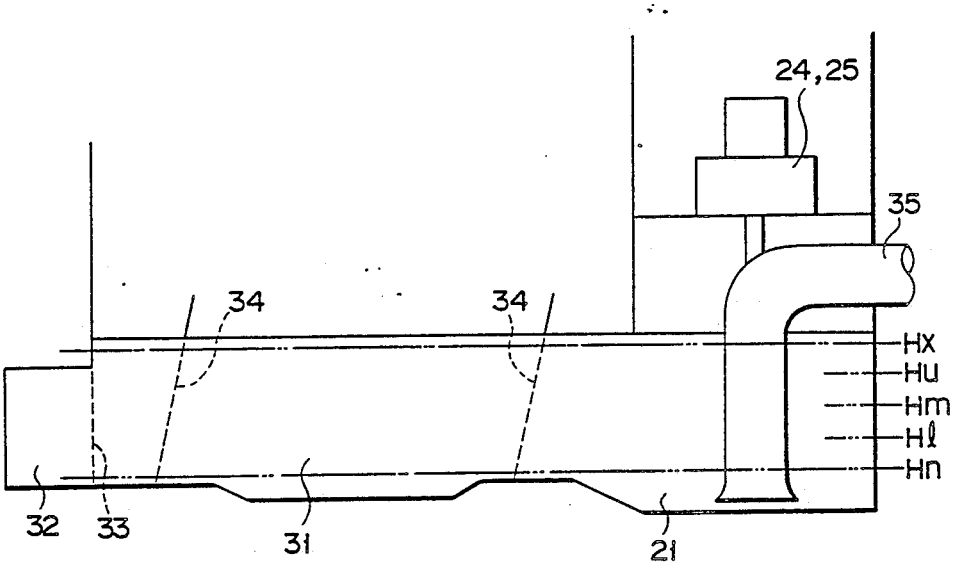
FIG. 16 is a view for explaining a relationship between a structure and a water level of a pump well.

The computation period ΔTe (min) differs in accordance with a capacity Qu ($m^3/s$) of the unit storm sewage pump 24. The computation period ΔTe (min) is set shorter when the capacity of the unit pump is large and longer when it is small. Therefore, the computation period must be determined in consideration of a pump capacity ratio Vp. The pump capacity ratio Vp is represented by an index representing a reduction ratio of a water level of a pump well between the upper and lower limits obtained when a single storm sewage pump is operated for the period ΔTe without inlet water. For example assuming that a bottom area of the pump well 21 having a sedimentation basin 31 as shown in FIG. 16 is A and uppermost and lowermost water levels of the pump well are Hx and Hn, respectively, the pump capacity ratio Vp is given by the following equation:

$$Vp=60.0\cdot Qu\cdot\Delta Te/\}(Hx-Hn)A\}$$

Therefore, when pump capacity $Qu=2$ ($m^3/s$) and the volume of the pump well 21 is 10.360 ($m^3$), $Vp=\Delta Te/30$. Assuming that Vp=0.2, computation period ΔTe=0.6 (min). Referring to FIG. 13, reference numeral 32 denotes an inlet port; 33, a gate; 34, a screen; and 35, a drain. In addition, in FIG. 16, Hx denotes an uppermost water level; Hu, an upper water level; Hm, a middle water level; Hl; a lower water level; and Hn, a lowermost water level. The pump number determining unit 11 operates the pumps 24 while maintaining the water level within the range between the uppermost and lowermost water levels. The middle water level Hm is an average value of the uppermost and lowermost water levels, the upper water level Hu is a water level in the middle of the uppermost water level and the middle water level, and the lower water level H1 is a water level in the middle of the lowermost water level and the middle water level.

The pump operation algorithm will be described. The storm water pump 24 must be operated in accordance with characteristics of a flow of storm water to be drained. The storm water flow characteristics depend on rainfall characteristics of a drainage basin for receiving the rainfall. In this case, it is considered that the rainfall characteristics actively affect and the drainage basin characteristics passively affect. That is, an influence of the former is larger than that of the latter. The rainfall characteristics have temporal and spatial variations and therefore are preferably considered as stochastic (or random) process. An influence of the rainfall characteristics on the pump operation is that even when a flow of water flowing in a pump well is increased, an inlet flow is not always increased in the next computation period. For this reason, an actual pump operation may be performed such that when an inlet flow heightens the water level of the pump well, the number of pumps to be operated is increased, and when the water level is decreased, the number of pumps to be operated is decreased. In this method, however, a change frequency of the number of pumps to be operated is increased. In this embodiment, therefore, (1) the pump capacity ratio Vp is set to be a slightly lower value (e.g., 0.2), and (2) in order to decrease the change frequency of the number of pumps to be operated, only a part of a change in the number of pumps obtained by a pump operation number change calculation is executed at a certain computation time, and execution of the remaining change is determined in the next computation time. For example, when the number of pumps to be operated is calculated to be three while the number of operating pumps is one, two pumps must be additionally operated. In this embodiment, however, only one pump is additionally operated as a result of the computation, and whether the other one is additionally operated is determined in the next computation time. In this manner, the pump operation number change frequency can be decreased.

When an indication value of the water level gauge 22 is $H_{Ko-\Delta Te}$ and the number of pumps to be operated is $I_{Ko-\Delta Te}$ at a computation time Ko−ΔTe, the number of pumps to be operated is determined in accordance with the following four steps at the next computation time and subsequent times.

Step 1 . . . A flow QKo of storm water flowing into the pump well 21 is calculated by runoff analysis.

Step 2 . . . Water level correction amount $Qh=(H_{Ko-\Delta Te}-Hm)\cdot A$ is calculated. Note that if $H1\leqq H_{Ko-\Delta Te}\leqq Hu$, Qh=0 is set.

Step 3 . . . The number $I_{Ko}$ of pumps to be operated is calculated from the inlet flow $Q_{Ko}$ and the water level correction amount Qk in accordance with the following equation:

$$I_{Ko}=INT\{0.5+(Q_{Ko}+Q_h)/Q_u\}$$

where INT [x] is the integral part of x.

Step 4 . . . Operation number difference $Id=I_{Ko-\Delta Te}-I_{Ko}$ is calculated.

Note that (a) if $Id \leqq 1$ and $H_{Ko-\Delta Te} > Hm$, $Id = 1$ (b) if $Id \geqq 1$ and $H_{Ko-\Delta Te} \leqq Hm$, $Id = 0$ (c) if $Id \leqq -1$ and $H_{Ko-\Delta Te} \geqq Hm$, $Id = 0$ (d) if $Id \leqq -1$ and $H_{Ko-\Delta Te} < Hm$, $Id = -1$.

Figure 17:
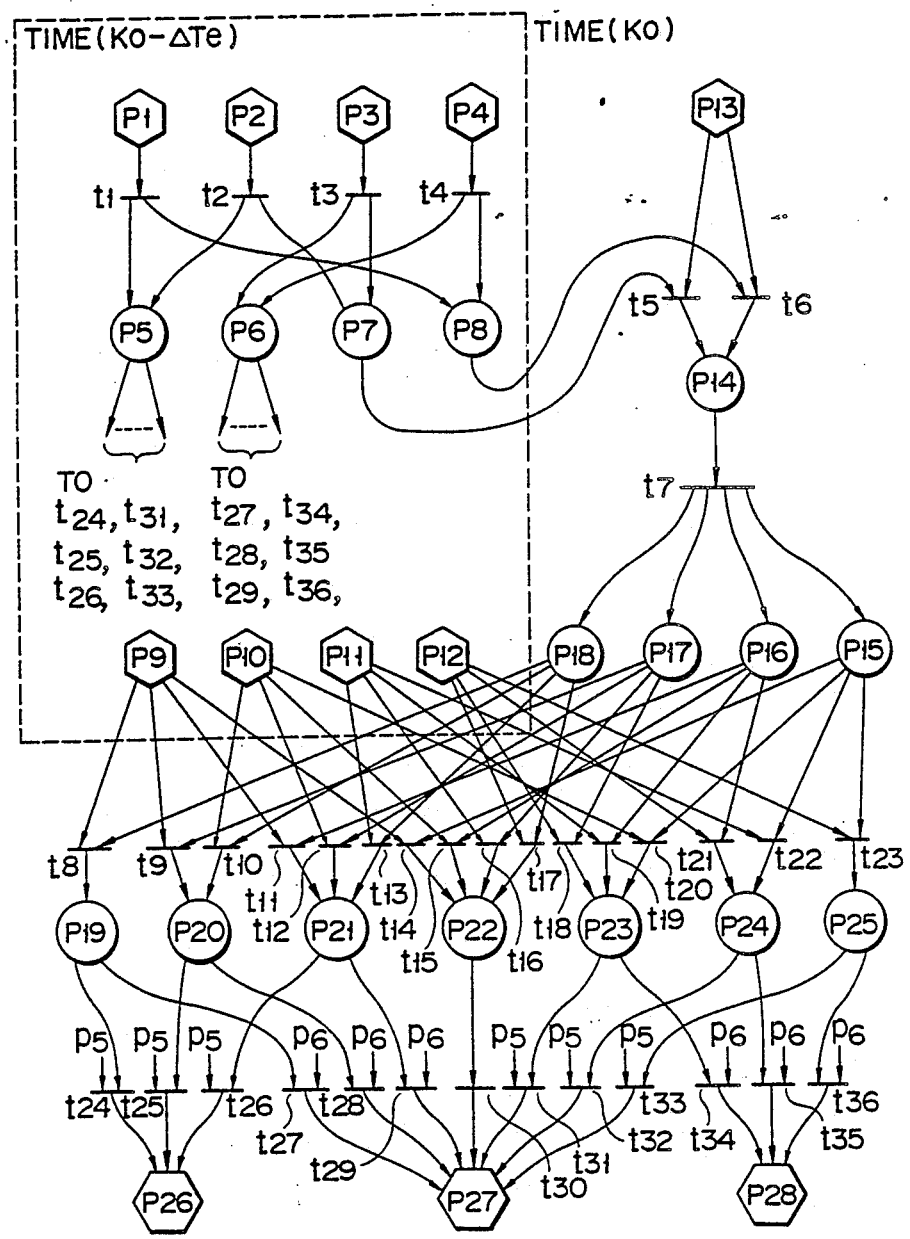
FIG. 17 is a view showing a Petri network for determining the number of pumps to be operated.

FIG. 17 shows a Petri net graph for changing the number of pumps to be operated in accordance with the above steps when the number of storm water pumps is three. Referring to FIG. 17, a block denoted by reference symbol Pi (i=1, 2, . . . , 28) represents a function of the place. More specifically, reference symbol $P_1$ represents that the water level is in a first lower region at a previous time (Ko−ΔTe); $P_2$, the water level is in a second lower region at the previous time; $P_3$, the water level is in a second upper region at the previous time; P4, the water level is in a first upper region at the previous time; P5, the water level is in a lower region at the previous time; P6, the water level is in an upper region at the previous time; P7, a water level correction amount is not considered at the previous time; P8, the water level correction amount is considered at the previous time; P9, three pumps are operated at the previous time; P10, two pumps are operated at the previous time; P11, one pump is operated at the previous time; and P12, no pump is operated at the previous time. P13 represents an inlet flow forecast value obtained by runoff analysis at the current time; P14, a calculation of the number of pumps to be operated at the current time; P15, three pumps are operated at the current time; P16, two pumps are operated at the current time; P17, one pump is operated at the current time; P18, no pump is operated at the current time; P19, the number of pumps to be operated is decreased by three at the current time from that at the previous time; P20, the number of pumps to be operated is decreased by two at the current time from that at the previous time; P21, the number of pumps to be operated is decreased by one at the current time from that at the previous time; P22, the number of pumps to be operated is not increased/decreased at the current time from that at the previous time; P23, the number of pumps to be operated is increased by one from that at the previous time; P24, the number of pumps to be operated is increased by two at the current time from that at the previous time; P25, the number of pumps to be operated is increased by three at the current time from that at the previous time; P26, the number of pumps to be operated at the current time i determined to be decreased by one; P27, the number of pumps to be operated at the current time is determined not to be increased/decreased; and P28, the number of pumps to be operated at the current time is determined to be increased by one.

Referring to FIG. 17, the block P27 represents that the number of pumps to be operated is not increased/-decreased. Even if the number of pumps to be operated is determined to be decreased by three (P19), two (P20), and one (P21) or increased by one (P23), two (P24), and three (P25) by the computation result in step 3, the numbers of pumps to be operated are determined not to be increased/decreased in some cases. In addition, even when the number of pumps to be operated is determined to be decreased by three (P19) and two (P20) or increased by two (P24) and three (P25), the numbers of pumps to be operated are finally determined to be decreased by one (P26) or increased by one (P28) in some cases. All these functions contribute to decrease the change frequency of the number of pumps to be operated.

Table 3 compares change frequencies of the number of pumps to be operated between a conventional apparatus and the apparatus according to the embodiment of the present invention in five actual events. As is apparent from Table 3, the change frequencies of the number of pumps to be operated obtained by the apparatus according to the present invention are decreased much lower than those obtained by the conventional apparatus which changes the number of pumps to be operated on the basis of only the pump well water level.

TABLE 3

| Event No. | Rainfall (mm) | Rainfall Time (h) | Applied Method | Change Frequency |
|---|---|---|---|---|
| Rainfall Event 1 | 17 | 10 | Present Invention | 7 |
| | | | Conventional Method | 10 |
| Rainfall Event 2 | 20 | 19 | Present Invention | 10 |
| | | | Conventional Method | 14 |
| Rainfall Event 3 | 13 | 11 | Present Invention | 4 |
| | | | Conventional Method | 6 |
| Rainfall Event 4 | 49 | 14 | Present Invention | 5 |
| | | | Conventional Method | 22 |
| Rainfall Event 5 | 20 | 12 | Present Invention | 8 |
| | | | Conventional Method | 12 |

The output from the pump number determining unit 11 is the number Id of pumps to be operated obtained in step 4. The number Id is supplied to the driving controller 23 for each computation time to operate/stop the storm water pumps 24, thereby adequately setting a delivery rate. In this case, difference Id=0 means that no operation change command is generated. Therefore, the number of commands for changing the number of pumps to be operated can be decreased.

The data calibrating unit 7, the rainfall forecasting unit 9, the runoff analyzing unit 10, and the pump number determining unit 11 display the processed data on the display unit 8 in order to inform partial results of the data processing.

In the above embodiments, the rainfall data of the entire urban basin obtained by the radar raingage is calibrated by using the direct rainfall data of a plurality of points measured by the ground raingages. As a result, detailed two-dimensional rainfall data can be obtained throughout a wide area. Since the rainfall curve is forecasted by using a plurality of sets of rainfall data, the number of storm water pumps 24 to be operated can be correctly determined. In addition, in the above embodiment, whether the locus of the rainfall weighted, centroid moves forward in a certain direction is checked, and the computation mode is changed in accordance with the check result to obtain the rainfall curve. Therefore, the rainfall curve can be obtained with high precision. A moving distance, a moving direction, and the like of the rainfall distribution until the forecast time can be comparatively correctly forecasted. In the above embodiment, considering progress in urbanization, a runoff discharge of an urban area is calculated on the basis of the vertical relationship between the junctions in consideration of a transfer time of a drainage basin of a sewer pipeline network in addition to the rainfall curve data. For this reason, a slow of storm water flowing into the pump well 21 can be correctly calculated. Furthermore, the change frequency of the number of pumps to be operated obtained by the computation result of the pump number determining unit 11 is adjusted to be decreased. With all the above processing tasKs, the change frequency of the number of pumps to be operated can be decreased lower than that of the conventional apparatus in accordance with a rapid change in discharge of storm water flowing into the pump well.

The present invention is not limited to the above embodiment. In general, when a plurality of radar raingages are set in a wide area of interest, characteristics of rainfall differ in accordance with frequencies of radio waves transmitted from the radar raingages. In addition, if observation ranges of the radar raingages are widened, observation precision is degraded. In this case, data from the plurality of radar raingages may be processed such that data of a radar raingage having high precision is used to calculate a rainfall from the rainfall distribution MKo at the third stage in FIG. 7 by the rainfall forecasting unit 9, thereby forecasting the rainfall. The radar raingages to be used are mainly of a ground type. However, data from a meteorological satellite can be used.

In the flow chart shown in FIG. 7, at the first stage, for example, the Kd past rainfall mesh data are calculated each time the current computation time is updated. However, rainfall mesh data calculated in the past may be stored in the memory unit *7a* so that the stored data are directly used for rainfall mesh data at a past computation time and only rainfall mesh data at a current computation time is calculated.

In the above embodiment, the moving velocity vector is obtained on the basis of the positions of the centroid point at the current computation time Ko and the time Ko−3·Δtm. Similarly, for example, a movement such as a turning of the centroid can be checked. For example, when the moving velocity vector keeps bending in one direction to the right or left (Km−1) successive times, its locus is assumed to turn. In this case, i.e., when a bending angle $\alpha t$ ($t=Ko-(Km+1)\cdot\Delta Tm, \ldots, Ko$) is always in one direction, an average value of the angles can be used as a bending angle at a time $Ko+\Delta tr]K$ ($K=0, 1, 2, \ldots, Kf$). The bending angle is obtained by the following equation:

$$= \sum_{t=Ko-(Km+1)\cdot\Delta Tm}^{t=Ko} t/(Km-1)\cdot\Delta Tm$$

That is, a moving vector can be obtained from the vector connecting the centroids at the times Ko−ΔTm and Ko in consideration of the bending angle of the can be processed.

In order to perform runoff analysis of a sewage treatment plant in which a trunk sewer pipe is long and the trunk pipe and a pump well are connected to affect each other, the runoff analyzing unit 10 performs non-uniform analysis in consideration of both time and areal variations of a nonlinear partial differential simultaneous equation. A solution is positively or negatively obtained by calculus of finite differences. In this case, since a unit time width is set to be several seconds and a large amount of calculations are performed in consideration of pump discharge head characteristics or an interdrain frictional loss curve, a transient flow phenomenon can also be analyzed.

In the above embodiment, the middle water level Hm is set in the middle of the uppermost and lowermost water levels for the pump number determining unit 11. When a bottom area A of a pump well is a function (A=A(h)) of the water level h, a water level hm' at which the volume becomes half the total volume is set as the middle water level. The water level hm' is obtained by the following equation:

$$hm' = \int_{Hn}^{H'm} A(h)dh = (\tfrac{1}{2}) \int_{Hn}^{Hx} A(h)dh$$

When a heavy rainfall is forecasted water in a pump well must be drained before an inlet flow into the pump well is increased. In this case, a computation is performed by setting a middle water level Hm* lower than Hm or Hm'. The middle water level Hm* is selected by an operator and can be changed during operation. Moreover, the present invention can be variously modified and carried out without departing from the spirit and scope of the invention.

As has been described above, since temporal and spatial variations of a rainfall do not reproduce past data, it is very difficult to handle these variations. In the present invention, however, two-dimensional data obtained by the radar raingage is calibrated by data from the ground raingages. A rainfall curve in several hours from the present is forecasted from the calibrated rainfall data, thereby forecasting time-serial pump operation states in several hours from the present. In the present invention, in addition to rainfall curve forecast, a process in which a rainfall flows into a pump well via a sewer pipeline network is considered. That is, in the present invention, an inlet flow into the pump well is calculated in consideration of state changes at areally main points to determine the number of pumps to be operated. Therefore, drainage processing can be executed with a proper number of pumps in accordance with a rapid change in discharge of storm water flowing in the pump well. For this reason, in the present invention, houses can be maximally protected from being submerged by storm water and storm water can be drained to rivers with a minimum change frequency of the number of pumps to be operated.

What is claimed is:

1. A storm water pump operation control method of controlling an operation state of a plurality of storm water pumps for draining storm water flowing in a sewage treatment plant, comprising:

the step of acquiring rainfall distribution data representing a two-dimensional rainfall distribution state by using a radar rain gages;

the step of measuring actual rainfalls by using ground rain gages;

the rainfall forecasting step of calibrating the rainfall distribution data obtained by said radar rain gage by the rainfalls obtained by said ground rain gages, and forecasting a rainfall in a predetermined time from the present on the basis of several sets of the calibrated past rainfall distribution date; and the pump number determining step of forecasting a flow of storm water flowing in a pump well on the basis of the forecast rainfall obtained in said rainfall forecasting step.

2. A method according to claim 1, wherein said pump number determining step comprising the analyzing step of performing runoff analysis corresponding to characteristics of a drainage basin on the basis of the forecast rainfall obtained in said rainfall forecasting step to calculate a rainfall flow, and forecasting a flow of storm water flowing in said pump well; and the pump step of determining the number of pumps to be operated on the basis of the inlet flow of said pump well forecast in said analyzing step, a water level of a water level gauge, and the number of currently operating pumps.

3. A method according to claim 1, wherein said rainfall forecasting step comprises:

the step of receiving time-serial rainfall distribution data and calculating a rainfall weighted centroid of each set;

the step of checking whether the centroid moves with a predetermined rule;

the step of obtaining a position of the centroid in a predetermined time from the present in accordance with a predetermined rule if the centroid moves with the predetermined rule or by calculating an average value and variance of past positions of the centroid if the centroid moves without a predetermined rule;

the rainfall increasing/decreasing rate acquiring step of acquiring an increasing/decreasing rate of a rainfall from an area average value of the rainfall; and the step of, assuming that a latest rainfall distribution at a current computation time does not change for a predetermined period, moving the latest rainfall distribution to a position defined by the calculated centroid, calculating a rainfall in a area of a drainage basin of interest, and multiplying the rainfall by the increasing/decreasing rate to acquire a forecast rainfall.

4. A method according to claim 1, wherein said pump number determining step comprises:

the step of obtaining a flow of storm water flowing in said pump well on the basis of a forecasted rainfall of a drainage basin of interest having a sewer pipeline network including confluent and branch points and a pipeline transfer time between junctions of said sewer pipeline network; and the step of acquiring a flow of storm water flowing in said pump well including overflow of weirs if said sewer pipeline network includes the weirs.

5. A method according to claim 1, wherein said pump number determining step comprises:

the step of considering a water level correction amount to a middle water level in said pump well when a water level in said pump well approaches an uppermost or lowermost water level, and determining the number of pumps to be operated for draining a total of the correction amount and an inlet flow assuming that the total corresponds to a flow to be drained; and the pump number changing step of increasing the number of pumps to be operated by one when the determined number of pumps to be operated is larger by one or more than the number of currently operating pumps under the condition that the water level is higher than the middle water level, and decreasing the number of pumps to be operated by one when the number of pumps to be operated is smaller by one or more than the number of currently operating pumps under the condition that the water level is lower than the middle water level.

6. A storm water pump operation control apparatus for controlling an operation of a plurality of storm water pumps for draining storm water flowing in an urban area to rivers, which includes:

a pump well, connected to a sewer pipe, for receiving storm water;

storm water pumps for draining storm water in said pump well from said pump well;

a water level gauge located in said pump well; and pump number determining means for determining the number of pumps to be operated in consideration of a water level of said water level gauge and the number of currently operating pumps, a radar rain gage for observing a two-dimensional rainfall distribution state for each predetermined observation period;

ground rain gages, located at a plurality of points on a ground for measuring actual rainfalls on the ground;

rainfall forecasting means for calibrating rainfall distribution data obtained by said rader rain gage by the rainfalls obtained by said ground rain gages, and forecasting a rainfall in a predetermined time from the present on the basis of several sets of calibrated rainfall distribution data; and runoff analyzing means for performing runoff analysis corresponding to characteristics of a drainage basin on the basis of a forecasted rainfall obtained by said rainfall forecasting means to calculate a rainfall flow, and forecasting a flow of storm water flowing in said pump well, said pump number determining means determining the number of pumps to be operated in consideration of the flow of storm water flowing in said pump well calculated by said runoff analyzing means, the water level of said water level gauge, and the number of currently operating pumps.

7. An apparatus according to claim 6, where in said rainfall forecasting means comprises:

calibrating means for calibrating the rainfall distribution data obtained by said radar rain gage by the rainfalls obtained by said ground rain gages;

means for receiving several sets of the calibrated rainfall distribution data from said calibrating means to calculate a rainfall weighted centroid of each set, thereby obtaining a locus of the centroid;

means for using a moving direction and a moving velocity of the centroid when the moving direction of the centroid obtained from the locus of the centroid falls within a predetermined angle, and calculating an average value and variance of past centroids to acquire a moving direction and a moving velocity of the centroid when the moving direction of the centroid falls outside the predetermined angle;

rainfall increasing/decreasing rate acquiring means for acquiring an increasing/decreasing rate of a rainfall from an area average value of the rainfall;

means for, in order to forecast a rainfall in consideration of temporal and spatial variations of the rainfall, calculating a rainfall in an area of a drainage basin of interest assuming that a latest rainfall distribution at a current computation time does not change in several future computation periods and moves in the above moving direction at the above moving velocity; and forecast rainfall means for multiplying the rainfall calculated by said rainfall calculating means by the increasing/decreasing rate to acquire a forecasted rainfall.

8. An apparatus according to claim 6, wherein said runoff analyzing means comprises:

means for obtaining a flow of storm water flowing into said pump well in accordance with a forecasted rainfall of a drainage basin of interest having a sewer pipeline network including confluent and branch points and a pipeline transfer time between junctions of said sewer pipeline network; and means for acquiring a flow of storm water flowing in said pump well including an overflow of a weir if said sewer pipeline network has the weir.

9. An apparatus according to claim 6, wherein said pump number determining means comprises:

determining means for considering a water level correction to a middle water level when a water level of said pump well approaches an uppermost or lowermost water level, and determining the number of pumps to be operated for pumping up a total of a corrected amount and an inlet flow assuming that this total corresponds to a flow to be drained; and a pump number changing means for increasing the number of pumps to operated by one when the number of pumps to be operated determined by said determining means is larger by one or more than the number of currently operating pumps under the condition that the water level is higher than the middle water level, and decreasing the number of pumps to be operated by one when the number of pumps to be operated is smaller by one or more than the number of currently operating pumps under the operation that the water level is lower than the middle water level.

10. A storm water pump operation control apparatus for controlling an operation state of a plurality of storm water pumps for draining storm waster flowing into a sewage treatment plant to rivers, comprising:

a radar rain gage for observing a two-dimensional rainfall distribution state;

ground rain gages for measuring actual rainfalls on a ground;

rainfall forecasting means for calibrating two-dimensional rainfall distribution data obtained by said radar rain gage by the rainfalls obtained by said ground rain gages, and forecasting a rainfall in a predetermined time from the present in accordance with several sets of the calibrated past rainfall distribution data; and pump number determining means for forecasting a rainfall of storm water flowing in said pump well on the basis of the forecast rainfall obtained by said rainfall forecasting means, and determining the number of pumps to be operated.

11. An apparatus according to claim 10, wherein said pump number determining means comprises:

analyzing means for performing runoff analysis corresponding to characteristics of a drainage basin on the basis of the forecast rainfall obtained by said rainfall forecasting means to calculate a rainfall flow, thereby forecasting a flow of water flowing in said pump well; and means for determining the number of pumps to be operated on the basis of an inlet flow of said pump well forecast by said analyzing means, a water level of a water level gauge, and the number of currently operating pumps.

12. An apparatus according to claim 5, wherein said rainfall forecasting means comprises:

means for receiving a static rainfall forecast representing that a certain amount of rain falls within a certain time; and means for forecasting a rainfall within a predetermined time range for a certain rainfall event on the basis of a plurality of sets of past rainfall distributions and the static rainfall forecast.

13. An apparatus according to claim 10, wherein said rainfall forecasting means comprises:

means for calculating a position of a weighted centroid of a rainfall distribution to obtain a locus of the centroid;

means for forecasting a position of the centroid in a predetermined time from the present on the basis of the locus of the centroid; and increasing/decreasing rate acquiring means for acquiring an increasing/decreasing rate of a rainfall on the basis of past rainfall data of a current rainfall event;

means for moving a latest rainfall distribution to the forecasted position; and means for calculating a rainfall in a drainage basin to be observed and multiplying the calculated rainfall by the increasing/decreasing rate to acquire a forecast rainfall on the basis of the moved rainfall distribution.

14. An apparatus according to claim 10, wherein said rainfall forecasting means comprises;

means for receiving time-serial rainfall distribution data and calculating a rainfall weighted centroid of each set of data;

means for checking whether the centroid moves with a predetermined rule;

means for calculating a position of the centroid in a predetermined time from the present in accordance with a predetermined rule if the centroid moves with the predetermined rule or by calculating an average value and variance of positions of the past centroid if the centroid moves without a predetermined rule;

rainfall increasing/decreasing rate acquiring means for acquiring an increasing/decreasing rate of a rainfall on the basis of an area average value of the rainfall; and means for, assuming that a latest rainfall distribution at a current computation time does not change in a predetermined period, moving the latest rainfall distribution to a position defined by the calculated centroid, calculating a rainfall in an area of a drainage basin of interest, and multiplying the calculated rainfall by the increasing/decreasing rate to acquire a forecast rainfall.

15. An apparatus according to claim 10, wherein said pump number determining means comprises:

means for obtaining a flow of storm water flowing in said pump well on the basis of a forecast rainfall of a drainage basin of interest having a sewer pipeline network including confluent and branch points and a pipeline transfer time between junctions of said sewage pipeline network; and means for acquiring a flow of storm water flowing in said pump well including an overflow of a weir if said sewer pipeline network, includes the weir.

16. An apparatus according to claim 10, wherein said pump number determining means comprises:

determining means for considering a water level correction amount to a middle water level when a water level of said pump well approaches an uppermost or lowermost water level, and determining the number of pumps to be operated for pumping up a total of correction amount and an inlet flow assuming that this total corresponds to a flow to be drained; and pump number changing means for increasing the number of pumps to operated by one when the number of pumps to be operated determined by said determining means is larger by one or more than the number of currently operating pumps under the condition that the water level is higher than the middle water level, and decreasing the number of pumps to be operated by one when the number of pumps to be operated is smaller by one or more than the number of currently operating pumps under the condition that the water level is lower than the middle water level.

* * * * *